US005521328A

United States Patent [19]

Kakishita

[11] Patent Number: 5,521,328

[45] Date of Patent: May 28, 1996

[54] ELECTRONIC MUSICAL INSTRUMENT FOR SIMULATING WIND INSTRUMENT MUSICAL TONES

[75] Inventor: Masahiro Kakishita, Hamamatsu, Japan

[73] Assignee: Yamaha Corporation, Japan

[21] Appl. No.: 108,907

[22] Filed: Aug. 18, 1993

[30] Foreign Application Priority Data

Aug. 21, 1992 [JP] Japan ..... 4-223059

[51] Int. Cl.[6] ..... G10H 1/12; G10H 5/00

[52] U.S. Cl. ..... 84/661; 84/659; 84/630

[58] Field of Search ..... 84/600, 622, 630, 84/659, 660, 661

[56] References Cited

U.S. PATENT DOCUMENTS

| | | | |
|---|---|---|---|
| 4,649,783 | 3/1987 | Strong et al. . | |
| 4,984,276 | 1/1991 | Smith . | |
| 5,286,913 | 2/1994 | Higashi | 84/622 |
| 5,308,918 | 5/1994 | Yamauchi et al. | 84/622 |
| 5,373,098 | 12/1994 | Kitayama et al. | 84/659 |

FOREIGN PATENT DOCUMENTS

| | | |
|---|---|---|
| 2-287395 | 11/1990 | Japan . |
| 3-233499 | 10/1991 | Japan . |

*Primary Examiner*—William M. Shoop, Jr.
*Assistant Examiner*—Jeffrey W. Donels
*Attorney, Agent, or Firm*—Graham & James

[57] ABSTRACT

An electronic musical instrument simulating a wind instrument is fundamentally configured by a loop circuit at least containing a linear portion and a non-linear portion. The linear portion simulates a pipe portion of the wind instrument, while the non-linear portion simulates a breath-blowing portion of the wind instrument so as to produce an excitation signal, which is supplied to the linear portion. By an interaction between the linear portion and the non-linear portion which is carried out while a signal circulates through the loop circuit, a sounding characteristic of the wind instrument is simulated. In order to accurately simulate a jet reed instrument (e.g., organ pipe), there are further provided a delay circuit and an edge tone generator. The delay circuit imparts a delay time to the output signal of the linear portion, and then, a delayed signal is supplied to the non-linear portion. The delay time corresponds to a time which is required when an air flow passing through a slit reaches an edge in the jet reed instrument. The edge tone generator generates a noise signal representing an edge tone (or an aeolian tone) which is unique to the jet reed instrument. The noise signal is mixed with the output signal of the non-linear portion, and then, a mixed signal is supplied to the linear portion. Thus, a sound of the jet reed instrument can be accurately simulated by a musical tone signal picked up from the loop circuit.

10 Claims, 20 Drawing Sheets

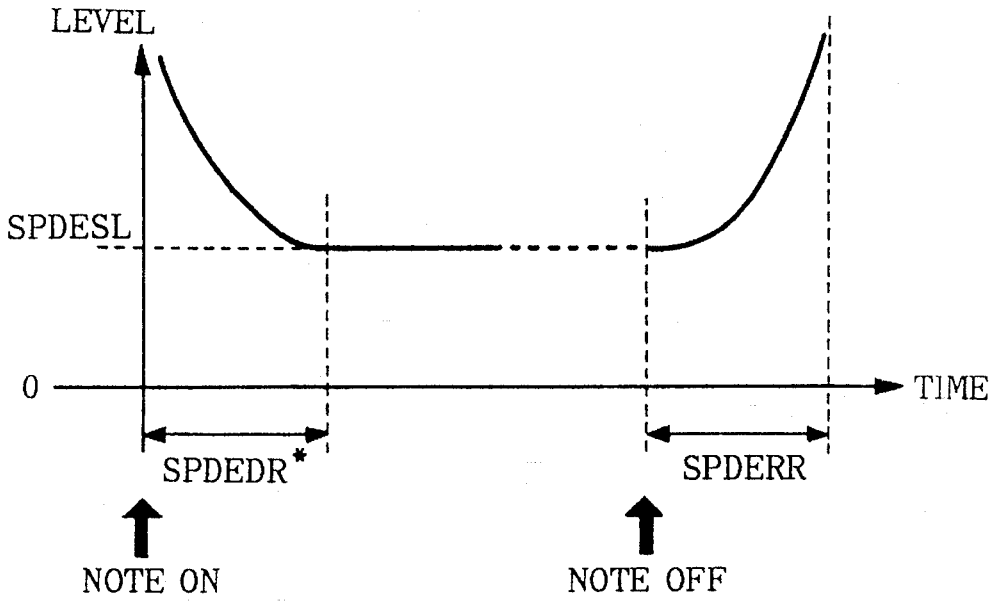
FIG.15
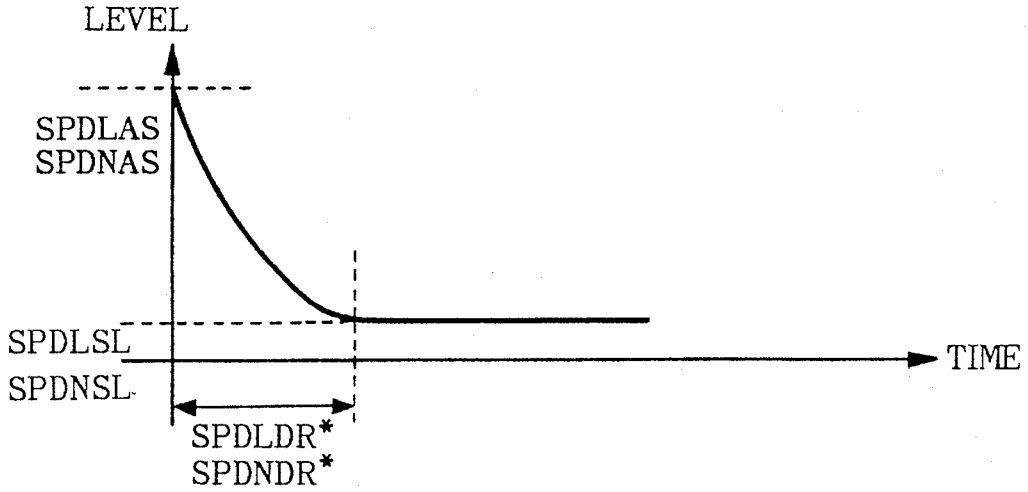
FIG.16
| PBEND | DATA |
|---|---|
| 7FH | 0.5 |
| ⋮ | ⋮ |
| 40H | 1.0 |
| ⋮ | ⋮ |
| 00H | 2.0 |
FIG.17

| PARA-METER | KEY SCALING | JET THICKNESS | JET VELOCITY | JET INCLI-NATION | NOISE CONTROL |
|---|---|---|---|---|---|
| NDLY*1 | ○ | × | × | × | × |
| LPFPP | ○ | × | × | × | × |
| HPFOT | ○ | × | × | × | × |
| HPFZJ | ○ | × | ○ | × | × |
| FFCEτ | ○ | × | ○ | × | × |
| FFCEO | ○ | × | ○ | × | × |
| τDLY*2 | ○ | × | ○ | × | × |
| NL_G | ○ | × | × | × | × |
| OFFSET | ○ | × | × | ○ | × |
| ZZ | ○ | ○ | × | × | × |
| HPFXV | ○ | ○ | × | × | × |
| LPFXV | ○ | ○ | × | × | × |
| LPFWV | ○ | ○ | × | × | × |
| APFWV | ○ | ○ | × | × | × |
| LPFNG | ○ | × | × | × | ○ |
| BPFFQ | ○ | × | × | × | × |
| BPFQQ | ○ | × | × | × | × |
| NGAMP | ○ | × | × | × | ○ |

FIG.30

ELECTRONIC MUSICAL INSTRUMENT FOR SIMULATING WIND INSTRUMENT MUSICAL TONES

BACKGROUND OF THE INVENTION

1. Field of the Invention

The present invention relates to an electronic musical instrument which is suitable for simulating sounds produced from wind instruments.

2. Prior Art

In these days, several kinds of algorithms used for physical models of sound sources which can create continuous sounds are developed in order to simulate the sounds produced from a bowed instrument, a single-reed instrument (e.g., saxophone) and a lip-reed instrument. When forming the physical model of sound source, the following steps are required: a tone-generation mechanism of a non-electronic musical instrument to be simulated is clearly analyzed; such tone-generation mechanism is modeled; then, the algorithms which can be implemented to a digital signal processor (i.e., DSP) are constructed.

Conventionally, the electronic musical instrument which is designed to simulate the tone-generation mechanism of the wind instrument having a reed is configured by a non-linear portion, a linear portion and a non-linear/linear interacting portion. In the reed wind instrument, a reed is provided in a mouthpiece, while there are provided a non-linear portion simulating operations of a mouthpiece portion and a linear portion simulating operations of a resonant pipe portion. Herein, signals are directly transmitted between the non-linear portion and the linear portion, resulting that a musical tone signal is produced.

Meanwhile, there is existed another type of the wind instrument, which is called a jet reed instrument. In this instrument, a thin diaphragm is vibrated in response to a jet flow which passes through a slit and is applied thereto. This thin diaphragm functions as the reed. Thus, a musical tone is produced from the jet reed instrument by an interaction between an air flow and a sound pressure produced in a pipe. In the jet reed instrument, a time lag (or delay time) should be inevitably occurred until the jet flow produced from lips reaches the slit of the mouthpiece. Further, when the jet flow collides with an upper-side lip, special sounds such as a so-called edge tone or an aeolian tone (i.e., noise component) are produced from the jet reed instrument. Thus, unique sounding effects can be imparted to the jet reed instrument by use of the above-mentioned time lag and special sounds.

However, the conventional electronic musical instrument is not designed upon the consideration of the tone-generation mechanism of the jet reed instrument described above. Thus, there is a problem in that the sounds unique to the jet reed instrument cannot be simulated well by the conventional electronic musical instrument.

SUMMARY OF THE INVENTION

It is accordingly a primary object of the present invention to provide an electronic musical instrument which can produce the musical tones which are unique to the jet reed instrument.

An electronic musical instrument according to the present invention is fundamentally configured by a loop circuit which at least contains a linear portion and a non-linear portion. The linear portion imparts a delay time to an input signal thereof, wherein the delay time corresponds to a frequency of a musical tone to be produced. The non-linear portion performs a predetermined non-linear function on an input signal thereof. An excitation signal is applied to the loop circuit in which it is circulated through. Then, a signal picked up from the loop circuit is outputted as a musical tone signal which synthesizes a sound of a non-electronic musical instrument to be simulated. In order to simulate a feature of the jet reed instrument, a delay circuit is further incorporated into the loop circuit and is connected with the non-linear portion. Further, a noise generator is provided to generate a noise signal which is supplied to the non-linear portion.

In the above-mentioned configuration, a pipe portion of the wind instrument is simulated by the linear portion. Due to the loop configuration, the linear portion and the non-linear portion interacts with each other. The delay circuit is provided to simulate a time which is required when the air flow passed through a slit reaches an edge in the jet reed instrument. The noise generator is provided to simulate an edge tone which is produced when a jet flow collides with the edge of the jet reed instrument.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings:

FIG. 15 is a graph showing a waveform of a jet-velocity envelope signal produced in a circuitry shown in FIG. 14;

FIG. 16 is a graph showing a waveform of a noise envelope signal produced in the circuitry shown in FIG. 14;

FIG. 17 is a drawing showing contents of a bend table shown in FIG. 14;

FIG. 30 is a drawing which is used for explaining a relationship between inputs and outputs of the second control portion.

DESCRIPTION OF THE PREFERRED EMBODIMENT

Figure 1:
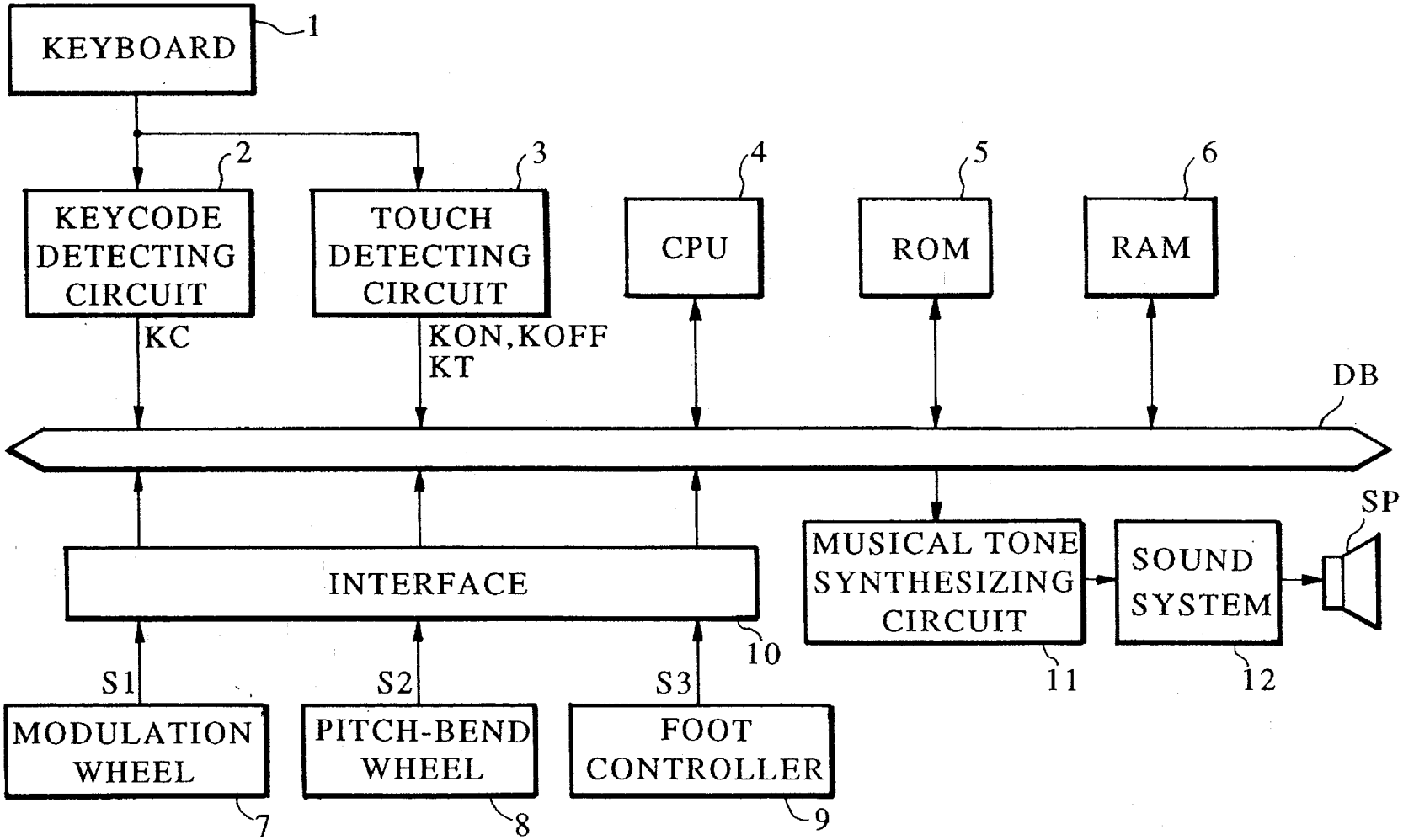
FIG. 1 is a block diagram showing an electronic configuration of an electronic musical instrument which simulates a jet reed instrument in accordance with an embodiment of the present invention.

Next, an electronic musical instrument according to an embodiment of the present invention will be described in detail by referring to the drawings.

FIG. 1 is a block diagram showing an electronic configuration of the electronic musical instrument simulating the jet reed instrument in accordance with an embodiment of the present invention. In FIG. 1, a keyboard 1 contains a plurality of white keys and black keys (hereinafter, simply referred to as keys). Each of the keys provides a sensor which detects a key operation (i.e., key-depression/release operation) and a key-operating velocity (i.e., key-depressing/releasing velocity). A keycode detecting circuit 2 detects a key operated by a performer so as to produce the corresponding key code, which is outputted onto a data bus DB. A touch detecting circuit 3 detects a key operation applied to each of the keys. When one of the keys is depressed, the touch detecting circuit 3 produces a key-on signal KON corresponding to the key depressed. The key-on signal KON is outputted onto the data bus DB. On the other hand, when the key-is released, the touch detecting circuit 3 produces a key-off signal KOFF corresponding to the key released. The key-off signal KOFF is outputted onto the data bus DB.

Further, the touch detecting circuit 3 produces and then outputs key-touch information KT onto the data bus DB. The key-touch information KT represents a key-depressing velocity and a key-depressing pressure with respect to the depressed key. In general, however, before outputting the key-touch information KT to the data bus DB, the key-touch information KT is somewhat corrected. The above-mentioned key-on signal KON, the keycode KC and the key-touch information KT are all supplied to a central processing unit (i.e., CPU) 4 through the data bus DB. In accordance with programs which are stored in a read-only memory (i.e., ROM) in advance, the CPU 4 carries out several kinds of processes, which will be described later. When carrying out the programs, the CPU 4 performs several kinds of operations on the basis of parameters which are stored in a random-access memory (i.e., RAM) 6, while several kinds of data are stored in the RAM 6.

Moreover, several kinds of manual-operation members (which are used to set tone colors for the musical tones to be produced, for example) are arranged on a panel face of a manual-operation panel (not shown) provided in the electronic musical instrument. As the manual-operation members, the present embodiment provides a modulation wheel 7, a pitch-bend wheel 8 and a foot controller 9 as shown in FIG. 1. The modulation wheel 7 is a wheel-type controller which is used to control a degree of modulation to be applied to the musical tone signal. This modulation wheel 7 produces a signal S1 in response to its rotating state, and then, this signal S1 is outputted onto the data bus DB through an interface 10. The pitch-bend wheel 8 is a wheel-type controller which is used to alter a tone pitch of the musical tone. The pitch-bend wheel 8 produces a signal S2 in response to its rotating state, and then, this signal S2 is outputted onto the data bus DB through the interface 10. Further, the foot controller 9 detects an operating state of a foot pedal unit which is plugged with the electronic musical instrument by use of a jack. In response to the operating state of the foot pedal unit, a signal S3 is produced and then outputted to the data bus DB through the interface 10.

A musical tone synthesizing circuit 11 synthesizes musical tone signals in accordance with the parameters given from the CPU 4. Herein, the musical tone signal is synthesized in the form of digital data, while this digital musical tone signal is supplied to a sound system 12. The sound system 12 converts the digital musical tone signal into an analog signal, which is amplified. Thereafter, the sound system 12 outputs an analog musical tone signal to a speaker SP, from which the corresponding musical tone is sounded.

Figure 2:
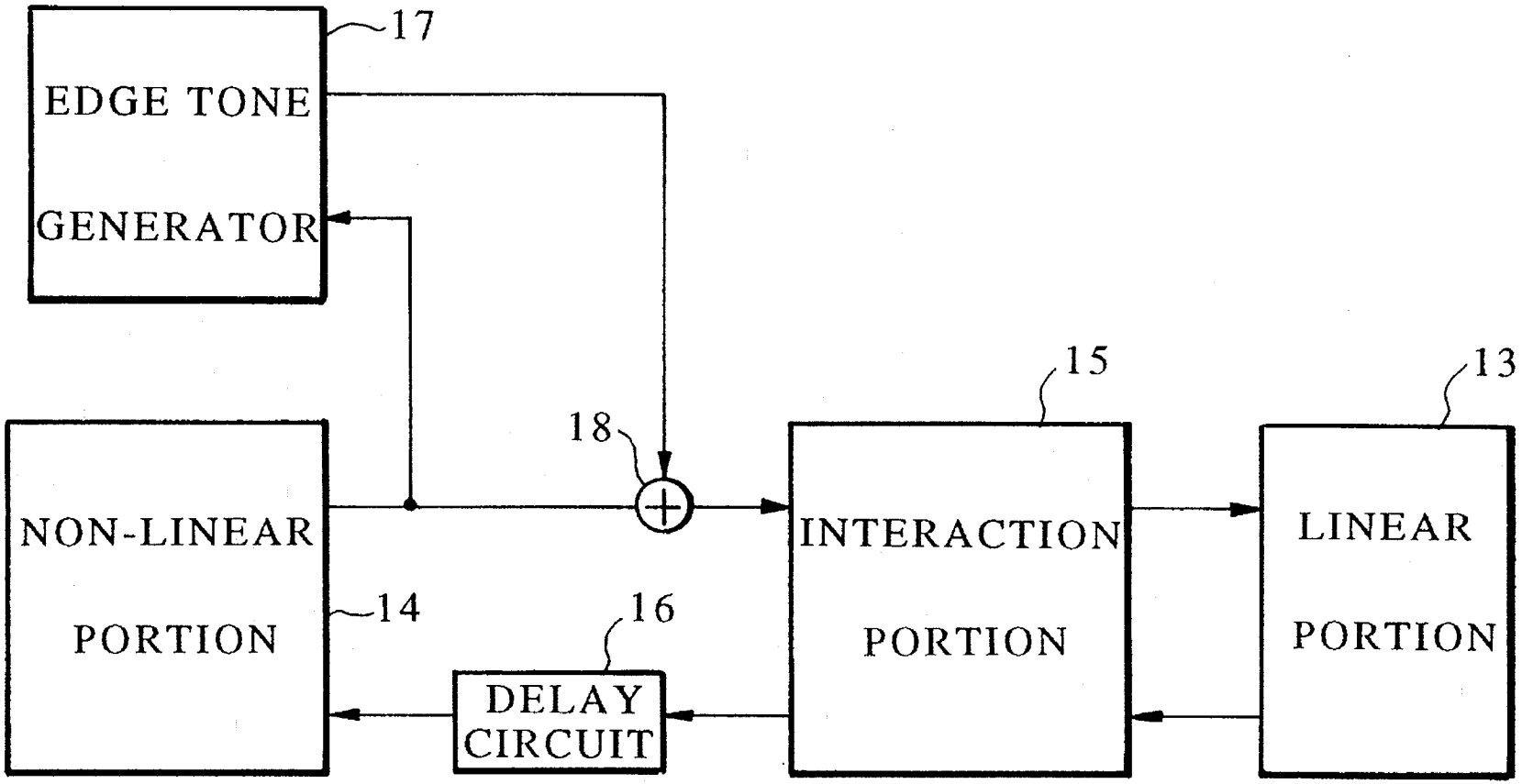
FIG. 2 is a block diagram showing a detailed configuration of a musical tone synthesizing circuit shown in FIG. 1.

Next, a detailed configuration of the musical tone synthesizing circuit 11 will be described by referring to a block diagram shown in FIG. 2. In FIG. 2, a pipe-body portion of the wind instrument to be simulated is embodied by a linear portion 13, while the operations of the jet reed is simulated by a non-linear portion 14 and a linear portion 13 which interacts with each other. The outputs of the linear portion 13 and non-linear portion 14 are supplied to an interaction portion 15 in which they interacts with each other so that input signals respectively applied to the linear portion 13 and the non-linear portion 14 are created. One of the input signals, which is created by the interaction portion 15, is transmitted to the non-linear portion 14 through a delay circuit 16. The reason why the delay circuit 16 is provided between the non-linear portion 14 and the interaction portion 15 lies in a feature of the jet reed instrument. In other words, in the actual jet reed instrument, an air flow which is produced in a mouth of the performer is carried into the jet reed instrument under operations of fluid particles which form a jet flow. After the air flow passes through the slit (e.g., lips of the performer located at a mouthpiece of a flute), there occurs a certain time until the air flow reaches an "edge" of the instrument (see FIG. 3). This certain time corresponds to a delay time of the delay circuit 16.

An edge tone generator 17 generates a noise component in response to an excitation signal. The noise component corresponds to the edge tone and the aeolian tone which are produced when the jet flow collides with the edge of the instrument. Then, a noise signal representing the noise component is supplied to an adder 18 which is provided in a closed loop consisting of the circuit elements 13 to 16 described before. The adder 18 adds the noise signal to the excitation signal. Then, an output of the adder 18 is supplied to the interaction portion 15.

One of the jet reed instruments, an organ pipe is chosen as an example. So, the description will be given with respect to the tone-generation mechanism of this example by referring to FIGS. 3, 4 and 5.

In these drawings, an air jet (i.e., jet flow) which is emerged on a mouth portion can be assumed as a thin diaphragm by which the air is separated into an inside air existing in the pipe and an outside air existing outside the pipe. This diaphragm is vibrated (or swung up and down) in response to a sound-pressure difference pJ ($N/^2$) which emerges between an upper place and a lower place with respect to the diaphragm.

Figures 4A, 4B, 4C:
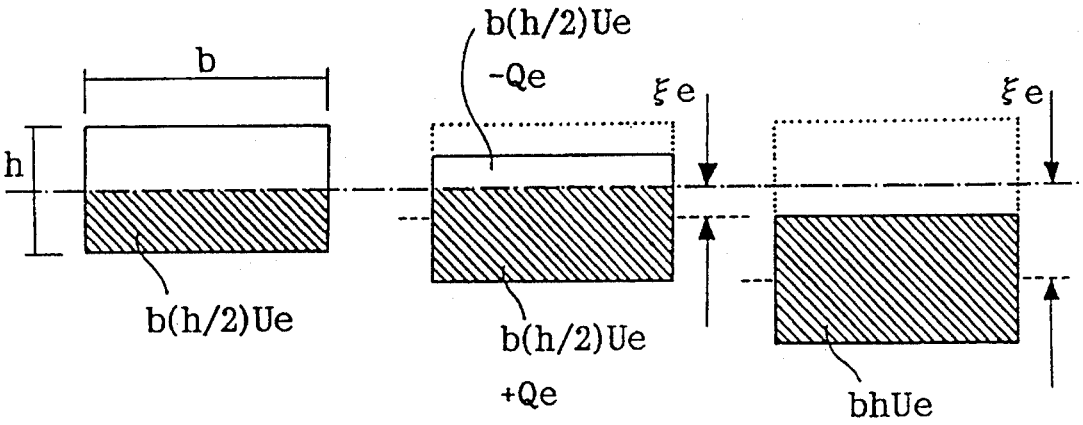
FIGS. 4(A) to 4(E) are drawings which are used for explaining operations and characteristics of an air flow which is occurred in a pipe of the jet reed instrument.

Due to the vibration of the diaphragm, the jet flow is alternatively blown to the inside and outside of the pipe. For convenience' sake, it is assumed that the jet flow which is blown through the slit at an initial velocity UO (m/s) collides with the edge at a velocity Ue (m/s), while the jet flow is not changed in width and thickness between the slit and the edge. As shown in FIG. 4(A), when a direct volume flow of the air is carried into the pipe by the jet flow, its velocity (referred to as a direct flow velocity) can be expressed as follows: b(h/2)Ue ($m^3/s$), where "b" (m) represents a width of the jet flow, while "h" (m) represents a thickness of the jet flow. Further, an additional volume is produced when vibrating the jet flow by a vibrating displacement $\epsilon_e$. A velocity of the another volume (hereinafter, referred to as an alternative flow velocity) is added to the aforementioned direct flow velocity in an alternating manner. The alternative flow velocity functions as a so-called acoustic driving source representing a volume flow velocity Qe ($m^3/s$). This acoustic driving source Qe can be expressed as follows: $Qe=b*Ue*F(\epsilon_e)$, where $F(\epsilon_e)$ represents a non-linear function. The value Qe turns to a positive value when the volume flow is blown into the inside of the pipe. The value $\epsilon_e$ represents a distance between the edge and a center of the jet flow. When the center of the jet flow exists outside the pipe, this value $\epsilon_e$ turns to a positive value. Herein, the velocity Ue of the jet flow is maintained constant at the edge in accordance with a sectional area of the jet flow represented by "bh". At the edge, the volume-flow velocity of the jet flow which is brought into the pipe is expressed as follow: b(h/2)Ue+Qe, while the volume-flow velocity of the jet flow which is blown outside the pipe is expressed as follows: b(h/2)Ue-Qe. Apparently, it is possible to assume that an alternative volume, represented by "Qe", is blown into the inside of the pipe from the outside of the pipe at the edge. This value Qe drives an acoustic flow-velocity field at the inside of the pipe (see FIGS. 4(B), 4(D) and 4(E)).

Figure 5:
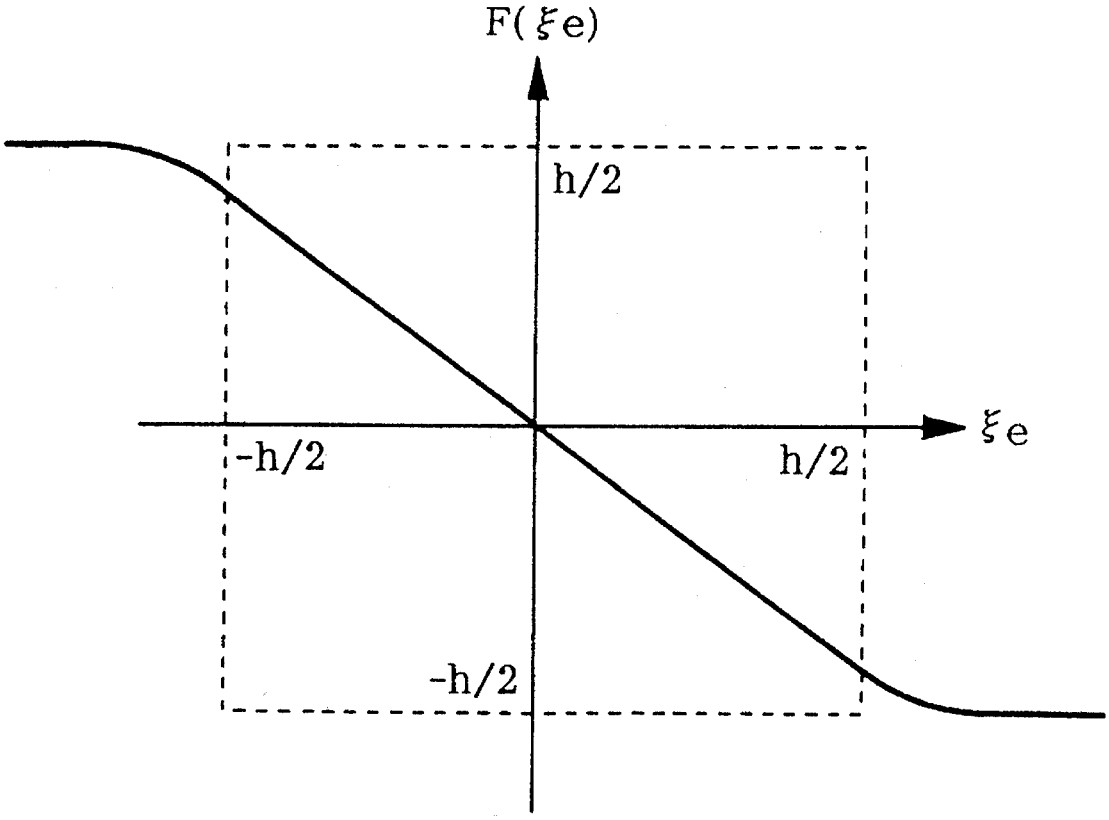
FIG. 5 is a graph showing an example of a non-linear function representing a characteristic of the air flow.

The aforementioned function $F(\epsilon_e)$ has a non-linear characteristic as shown in FIG. 5. This non-linear characteristic is saturated when the value $\epsilon_e$ exceeds a half of the thickness of the jet flow, i.e., "h/2" (see FIG. 4(C)). The vibrating displacement $\epsilon_e$ at the edge is proportional to the sound-pressure difference pj which is emerged between the upper place and the lower place with respect to the diaphragm (referred to as a jet diaphragm).

The jet diaphragm acts like a flexible cover provided on the mouth portion. Therefore, the fluid particles forming the jet flow are moved by a certain velocity containing a lateral-direction velocity component by the vibrating motion (relating to $\epsilon_e$of the jet flow. Herein, a lateral direction can be defined as a traversing direction with respect to the opening of the mouth portion. Incidentally, a volume-flow velocity of the air which is carried by the above-mentioned lateral-direction velocity component in the mouth portion is called as a vibrating volume-flow velocity Qm ($m^3/s$). The value Qm turns to a positive value when the air is blown outside the pipe. The vibrating volume-flow velocity Qm can be obtained by integrating the differential of the vibrating displacement $\epsilon_e$ of the jet diaphragm with respect to time along with the mouth portion.

As described above, the sound-pressure difference pj at the edge results in the acoustic driving source Qe and the vibrating volume-flow velocity Qm. On the other hand, an acoustic volume-flow velocity Qp ($m^3/s$) is emerged in the pipe. Under the consideration of the continuity of the flow velocity at a point Ⓐ existing at the inside of the mouth portion, the above-mentioned factors can be interpreted such that the acoustic driving source (i.e., alternative volume-flow velocity) Qe branches into the acoustic volume-flow velocity Qp and the vibrating volume-flow velocity Qm. Therefore, the following relationship is established: Qp=Qe−Qm. A branching ratio can be determined in response to a pipe-side impedance and a mouth-side impedance with respect to the point Ⓐ.

Figure 3:
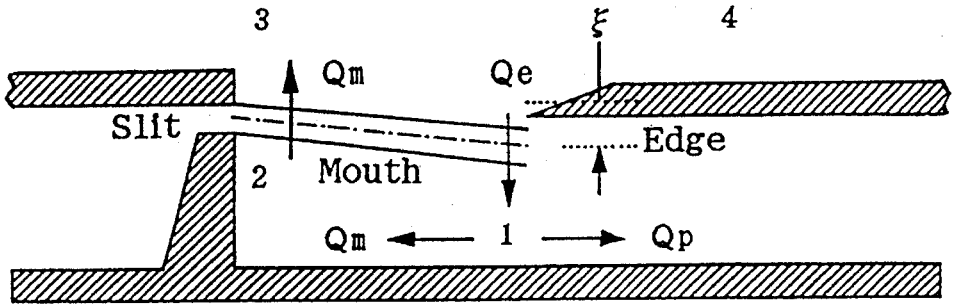
FIG. 3 is a sectional view illustrating a tone-generation mechanism of an organ pipe.
Figure 4D:
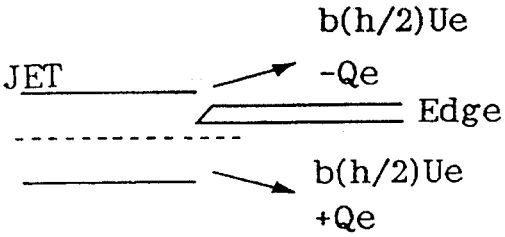
Figure 4E:
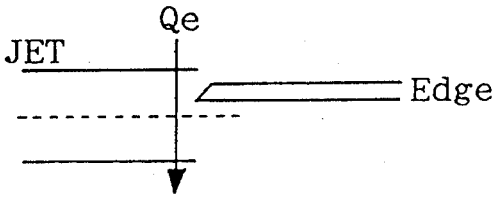

The oscillation mechanism as shown in FIG. 3 can be summarized as follows: when assuming an existence of the sound-pressure difference pJ, this sound-pressure difference pj results in the vibrating displacement $\epsilon_e$; and this vibrating displacement $\epsilon_e$ results in the acoustic driving source Qe; and then, the acoustic driving source Qe is divided into the vibrating volume-flow velocity Qm applied to the jet diaphragm and the acoustic volume-flow velocity Qp; thereafter, the vibrating volume-flow velocity Qm functions to produce the sound-pressure difference pj. Such circulating oscillation mechanism can be expressed as follows:

$$Pj \rightarrow \epsilon_e \rightarrow Qe \rightarrow Qm(Qp) \rightarrow pj.$$

In FIG. 3, pressures at points Ⓐ, Ⓑ, Ⓒ and Ⓓ are respectively designated by numerals p1, p2, p3 and p4. Herein, the point Ⓐ exists in the mouth portion; the point Ⓑ exists just below the jet diaphragm; the point Ⓒ exists just above the jet diaphragm; and the point Ⓓ exists above and far from the pipe. Due to the location of the point Ⓓ, the pressure p4 can be expressed as follows: p4≈0. Further, the sound-pressure difference pj which is emerged between the upper place and the lower place with respect to the jet diaphragm can be defined as follows: pj=p2−p3. By use of four pressures p1 to p4, it is possible to define several kinds of impedances as follow.

A vibration impedance Zj of the jet diaphragm:

$$Zj=(p2-p3)/Qm=pj/Qm.$$

An acoustic mouth impedance Zm:

$$Zm=(p1-p2)/Qm.$$

A mouth radiation impedance Zr:

$$Zr=(p3-p4)/(Qm-Qe)=-p3/Qp.$$

A pipe input impedance Zp:

$$Zp=(p1-p4)/Qp=p1/Qp.$$

The above-mentioned expression of the vibration impedance Zj can be rewritten as follows:

$$Zj=pj/Qm=\{bUE*W(\theta_e)/(\rho h\omega^2)\}^{-1}.$$

Further, the acoustic mouth impedance Zm is expressed as an impedance for a short opening pipe. Thus, this expression of Zm can be rewritten with respect to the air volume as follows:

$$Zm=j(\rho*lm/Seff)\omega$$

,where "lm" (m) represents an effective length of the mouth portion, while "Self" ($m^2$) represents an effective sectional area.

By assuming that the radiation from the mouth portion is identical to the radiation from a virtual piston having a radius "aeff" (m) without a baffle, the expression of the mouth radiation impedance Zr can be rewritten as follows:

$$Zr=(\rho/4c)*\omega^2+j(E*\rho/aeff)*\omega.$$

The above-mentioned term "E" represents an end correction for the radiation, and the value thereof is approximately equal to 0.7, while another term "c" ($m^2/s$) represents a sound velocity.

Since the pipe input impedance Zp is expressed as an impedance for an opening pipe having a length "l" (m), the foregoing expression can be rewritten as follows:

$$Zp=Zc[\{1+Sv*\exp(-j2\omega l)\}/\{1-Sv*\exp(-j2\omega l)\}].$$

The above-mentioned term "Sv" represents a reflection coefficient at an opening edge, while another term "Zc" represents a characteristic impedance. This characteristic impedance Zc can be expressed as follows: Zc=ρ*c/S, where "S" represents a sectional area of the pipe.

Figure 6:
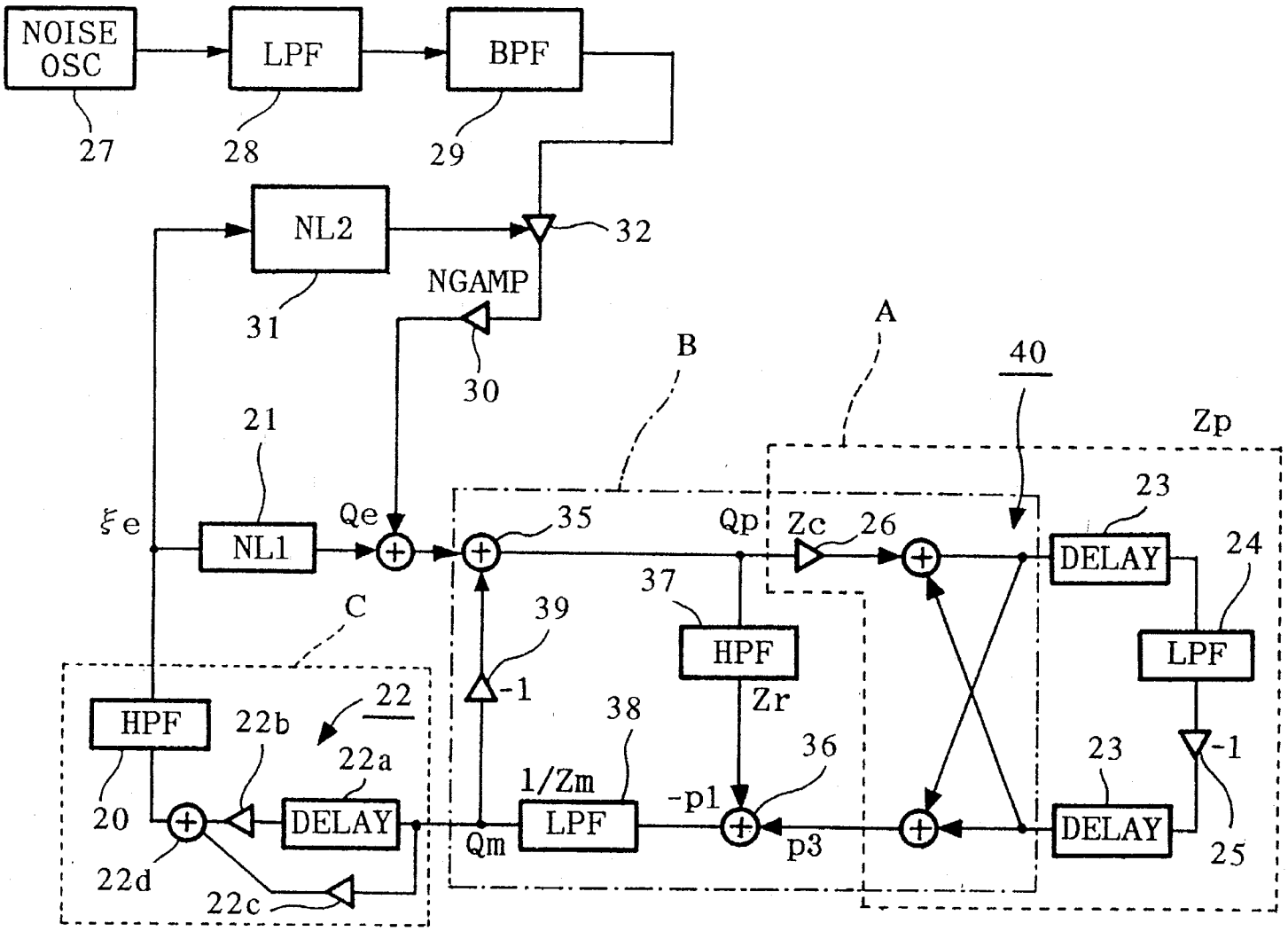
FIG. 6 is a block diagram showing an example of a circuitry embodying algorithms of the jet reed instrument to be simulated.
Figure 7:
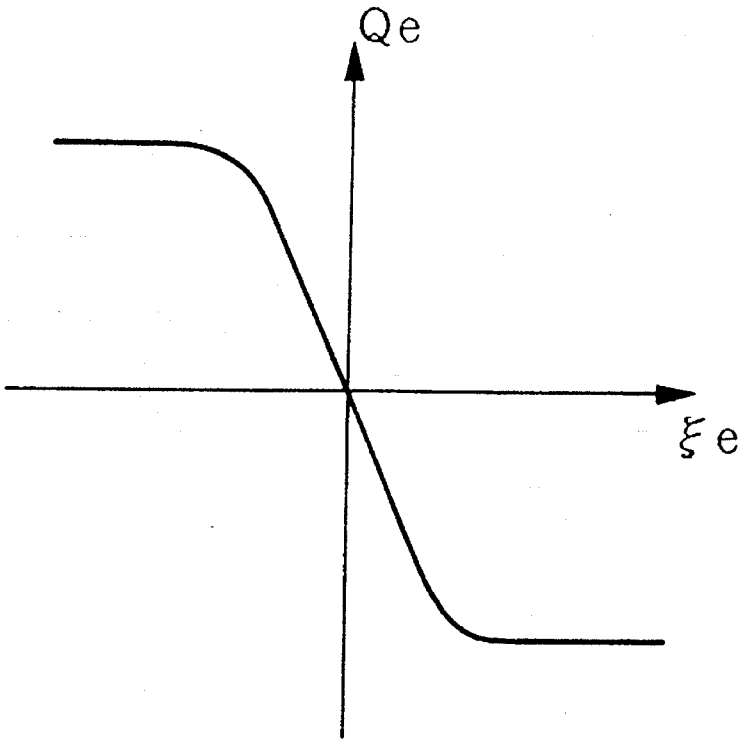
FIG. 7 is a graph showing a characteristic of data stored in a non-linear table 21 shown in FIG. 6.

Next, a detailed description will be given with respect to an algorithm simulating the above-mentioned tone-generation mechanism applied to the jet reed instrument by referring to a block diagram shown in FIG. 6. In FIG. 6, the aforementioned non-linear portion 14 shown in FIG. 2 is configured by a high-pass filter 20, a non-linear table 21 and a feed-forward comb filter 22. Herein, the non-linear table 21 stores data representing a characteristic as shown in FIG. 7, while the feed-forward comb filter 22 has a delay time corresponding to the time which is required when the jet flow passing through the slit reaches the edge. The feed-forward comb filter 22 consists of a delay circuit 22*a*, multipliers 22*b*, 22*c* and an adder 22*d*. An input signal of the filter 22 is delayed by the delay circuit 22*a*, and then, a delayed signal is added with the input signal, thus, a predetermined delay time is obtained.

Figure 8:
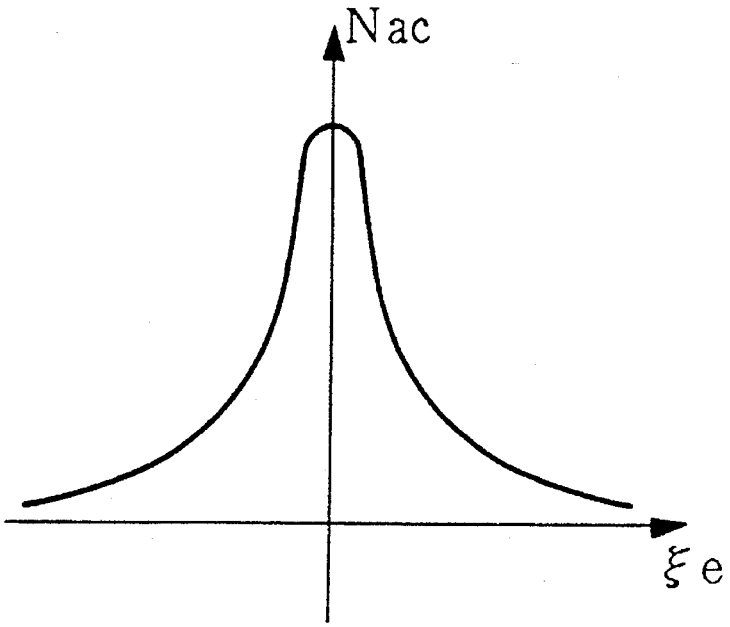
FIG. 8 is a graph showing a characteristic of data stored in a non-linear table 31 shown in FIG. 6.

A circuit block A contains delay elements 23, a low-pass filter 24 and multipliers 25, 26. Herein, each of the delay elements 23 corresponds to a pipe length; the low-pass filter 24 simulates an attenuation characteristic of the pipe; the multiplier 25 simulates a reflection of a sound-pressure wave at a pipe opening edge; and the multiplier 26 multiplies an excitation signal by the characteristic impedance Zc. The edge tone generator (or aeolian tone generator) 17 shown in FIG. 2 is configured by a noise oscillator 27, a low-pass filter 28, a band-pass filter 29, a multiplier 30, a non-linear table 31 and a multiplier 32. Herein, the multiplier 30, having a coefficient "NGAMP", functions to determine an amplitude of the signal passing therethrough; the non-linear table 31 stores data representing a non-linear characteristic as shown in FIG. 8; and the multiplier 32 multiplies the signal passing therethrough by a value which is read from the non-linear table 31 with respect to the distance $\epsilon_e$ between the edge and the center face of the jet flow.

A circuit block B corresponds to the aforementioned interaction portion 15 shown in FIG. 2. This circuit block B is configured by adders 35, 36, a high-pass filter 37, a low-pass filter 38, a multiplier 39 and a junction 40.

In the circuitry shown in FIG. 6, there exists a so-called delay free loop. This circuitry can be actually made by use of circuit components. However, in order to obtain a more accurate and detailed algorithm, the delay free loop is removed so as to re-design the circuitry as shown in FIG. 9.

Figure 9:
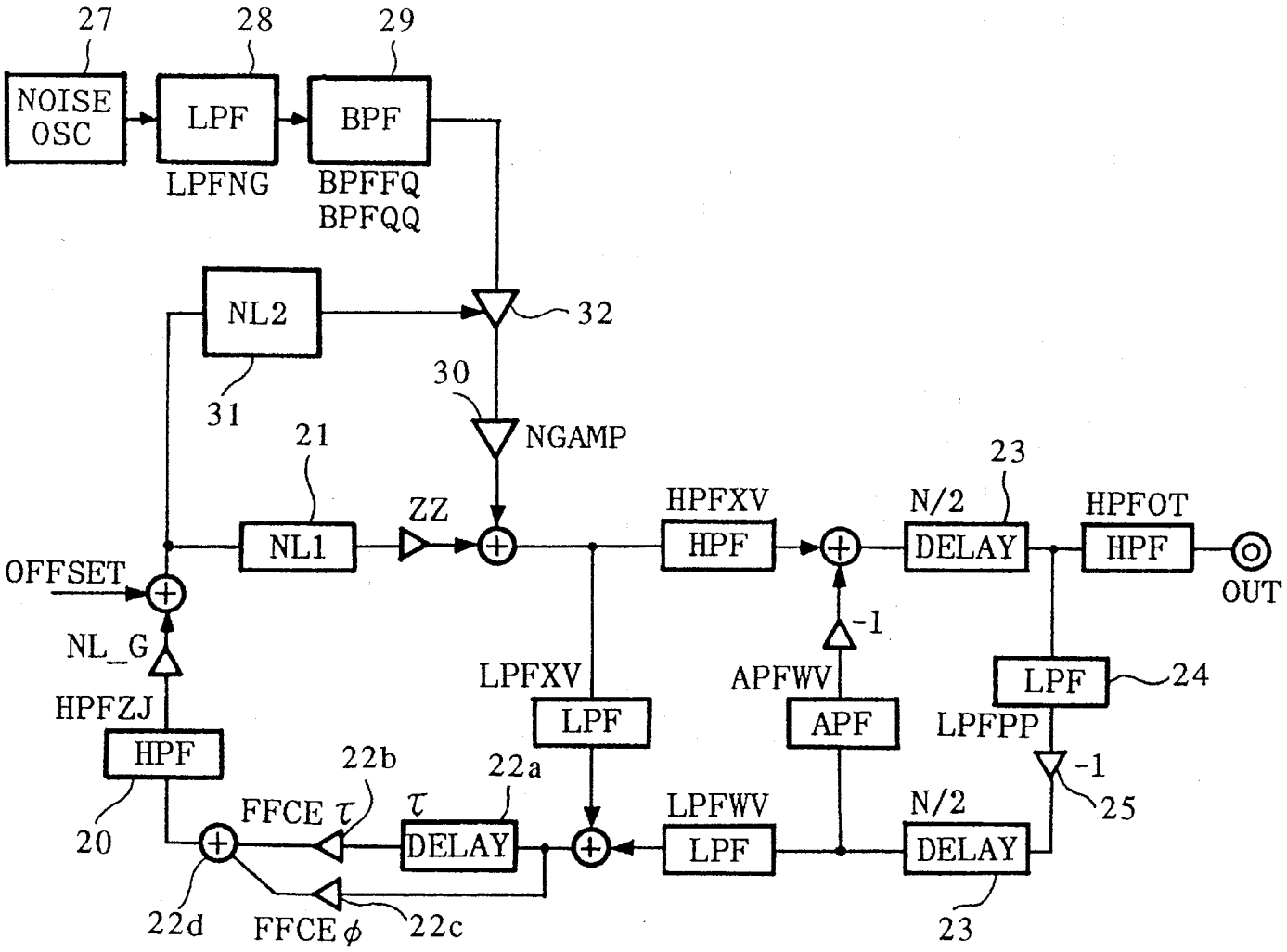
FIG. 9 is a block diagram showing another example of a circuitry embodying the algorithms of the jet reed instrument to be simulated.

The circuitry shown in FIG. 9 has the following parameters.

[Linear Portion]

LPFPP . . . a coefficient of low-pass filter representing an attenuation coefficient emerged at the inside of the pipe.

N . . . delay amount representing a pipe length.

[Non-Linear Portion]

HPFZJ . . . a coefficient of high-pass filter.

ρ . . . a delay amount representing a time by which the jet flow propagates from the slit to the edge.

FFCEO, FFCEN . . . a coefficient of feed-forward comb filter.

NL_G . . . a multiplication coefficient which functions to limit a range of addresses used for reading values from a non-linear table 1 (represented by a numeral "NL1") stored in the non-linear table 21.

OFFSET . . . an offset value applied to the address used for reading the value from the non-linear table.

ZZ . . . a multiplication coefficient which functions to limit an output value of the non-linear table.

[Interaction Portion]

HPFXV . . . a coefficient of high-pass filter.

LPFXV . . . a coefficient of low-pass filter.

LPFWY . . . a coefficient of low-pass filter.

APFWV . . . a coefficient of all-pass filter.

[Edge Tone Generator]

LPFNG . . . a coefficient of low-pass filter.

BPFFQ . . . a center frequency of band-pass filter.

BPFQQ . . . a factor Q of band-pass filter.

NGAMP . . . a multiplication coefficient which is used to limit an amplitude of a waveform representing the edge tone or the aeolian tone.

OFFSET . . . a distance (or an inclination) between the edge and the center of the jet flow.

ZZ . . . a thickness (or an intensity) of the jet flow.

The algorithm embodying the circuitry shown in FIG. 9 is implemented to the DSP.

Figure 10:
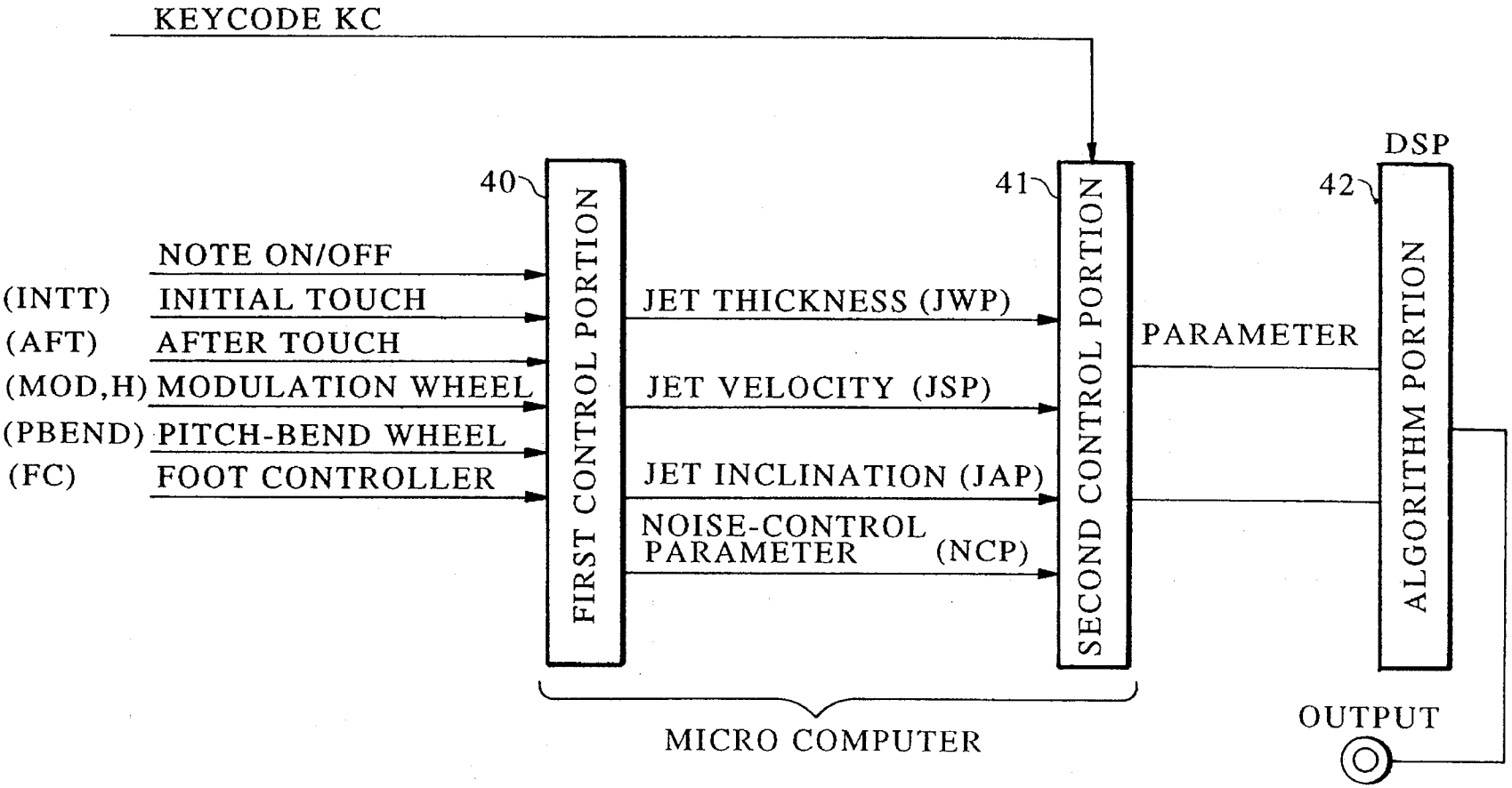
FIG. 10 is a block diagram showing an example of a control system which is suitable for a synthesizer keyboard device and is used for the circuitry shown in FIG. 6.

Next, the description will be given with respect to a musical performance which is played by use of a conventional synthesizer keyboard in accordance with the above-mentioned algorithm. FIG. 10 is a block diagram showing a control system which is applied to the synthesizer keyboard when embodying the algorithm. As manual-operable members, there are provided a keyboard, a pitch-bend wheel, a modulation wheel and a foot controller. Herein, the keyboard produces note-on information, note-off information, initial-touch information and after-touch information. By use of the above-mentioned four kinds of the manual-operable members, the following parameters can be altered.

(Keyboard)

keycode . . . an interval and a tone color (which are controlled by performing a key-scaling operation).

initial touch . . . a tone volume and a tone quality (which are controlled by changing the thickness of the jet flow).

after touch . . . a tone volume and a tone quality (which are controlled by changing the thickness of the jet flow); a so-called vibrato depth (which is controlled by changing a jet-flow velocity); and a so-called tremolo depth (which is controlled by changing the thickness of the jet flow).

modulation wheel . . . a tone quality (which is controlled by changing the inclination of the jet flow with respect to the edge).

pitch-bend wheel . . . an interval and a tone quality (which are controlled by changing a jet-flow velocity).

foot controller . . . a tone volume of the edge tone or the aeolian tone (which is represented by values "0" to "127" based on the MIDI control).

In FIG. 10, a first control portion 40 performs several kinds of processes on note-on data NON, note-off data NOFF, initial-touch data INTT, after-touch data AFT, modulation-wheel data MOD.H, pitch-bend-wheel data PBEND and foot-controller data FC so as to convert them into a jet thickness parameter JWP, a jet velocity parameter JSP and a jet inclination parameter JAP. The first control portion 40 also creates a noise-control parameter NCP which is used to control three parameters describing the characteristic of the jet flow, i.e., JWP, JSP and JAP. These parameters JWP, JSP, JAP and NCP are supplied to a second control portion 41. In the second control portion 41, a set of parameters are selected from parameters, each of which is subjected to the scaling operation and is stored in a memory in advance, with respect to each of the keycodes KC. On the basis of information given from the first control portion 40, the second control portion 41 calculates a current value with respect to each of the parameters used for the algorithm in real time, so that a result of the calculation is transferred to an algorithm portion 42, representing the algorithm shown in FIG. 9, which is implemented in the DSP.

Next, the description will be given with respect to a detailed configuration and operations of the first control portion 40. At first, the configuration of the first control portion 40 which performs a jet thickness control will be described in conjunction with FIGS. 11, 12 and 13.

[Jet Thickness Control]

Figure 11:
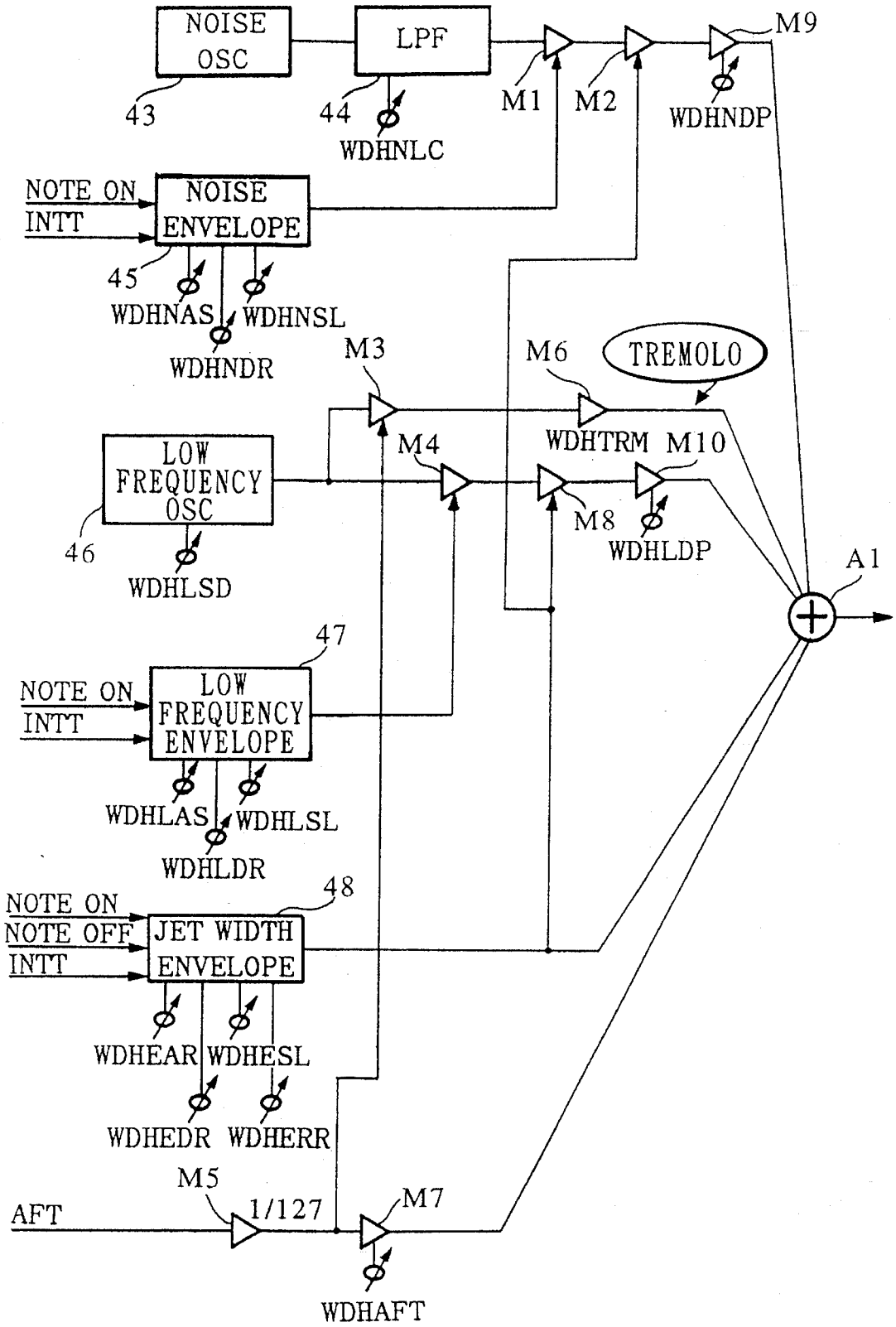
FIG. 11 is a block diagram showing an example of a first control portion shown in FIG. 10 which is configured when controlling a jet thickness.

In a block diagram shown in FIG. 11, a noise oscillator 43 creates a noise signal, which is supplied to a low-pass filter 44. The low-pass filter 44 receives a parameter WDHNLC which determines a cut-off frequency. In accordance with the parameter WDHNLC, the low-pass filter 44 performs a low-pass filtering operation on the noise signal. The output of the low-pass filter 44 is supplied to a multiplier M1. Meanwhile, in order to determine an envelope to be applied to the noise signal, a noise envelope generator 45 creates an envelope signal on the basis of a note-on signal "NOTE ON", an initial-touch signal "INTT", an attack level "WDHNAS", a decay rate "WDHNDR" and a sustain level "WDHNSL". The envelope signal is supplied to the multiplier M1. The multiplier M1 multiplies the noise signal by the envelope signal. Then, a result of the multiplication performed by the multiplier M1 is supplied to another multiplier M2.

Meanwhile, a low frequency oscillator 46 produces a signal having a predetermined low frequency in accordance with a speed parameter WDHLSD which determines an oscillation frequency. This signal is delivered to both of multipliers M3 and M4. A multiplier M5 multiplies the after-touch data AFT by "1/127" so as to output a value "AFT/127". This value "AFT/127" is delivered to the multiplier M3 in which the signal given from the low frequency oscillator 46 is multiplied by the value "AFT/127". Then, a result of the multiplication performed by the multiplier M3 is supplied to a multiplier M6. The above-mentioned value "AFT/127" outputted from the multiplier M5 is also delivered to a multiplier M7. The multiplier M6 multiplies the input signal thereof by a tremolo control depth WDHTRM, and then, a multiplication result thereof is outputted to an adder A1. Next, a low-frequency envelope generator 47 produces an envelope signal on the basis of the note-on signal NOTE ON, the initial-touch signal INTT, an attack level WDHLAS, the decay rate WDHLDR and a sustain level WDHLSL. This envelope signal is supplied to the multiplier M4. The multiplier M4 multiplies the output signal of the low frequency oscillator 46 by the envelope signal produced from the low-frequency envelope generator 47. Then, a result of the multiplication performed by the multiplier M4 is outputted to a multiplier M8.

Next, a jet-width envelope generator 48 generates an envelope signal to control the width of the jet flow on the basis of the note-on signal NOTE 0N, a note-off signal NOTE OFF, the initial-touch signal INTT, an attack level WDHEAR, a decay rate WDHEDR, a sustain level WDHESL and a release rate WDHERR. This envelope signal is delivered to the multipliers M2, M8 and the adder A1. The multiplier M2 multiplies the noise signal by the envelope signal produced from the jet-width envelope generator 48. Then, a result of the multiplication performed by the multiplier M2 is outputted to a multiplier M9. The multiplier M9 multiplies the output signal of the multiplier M2 by a noise depth WDHNDP. Then, a result of the multiplication performed by the multiplier M9 is outputted to the adder A1.

Figure 12:
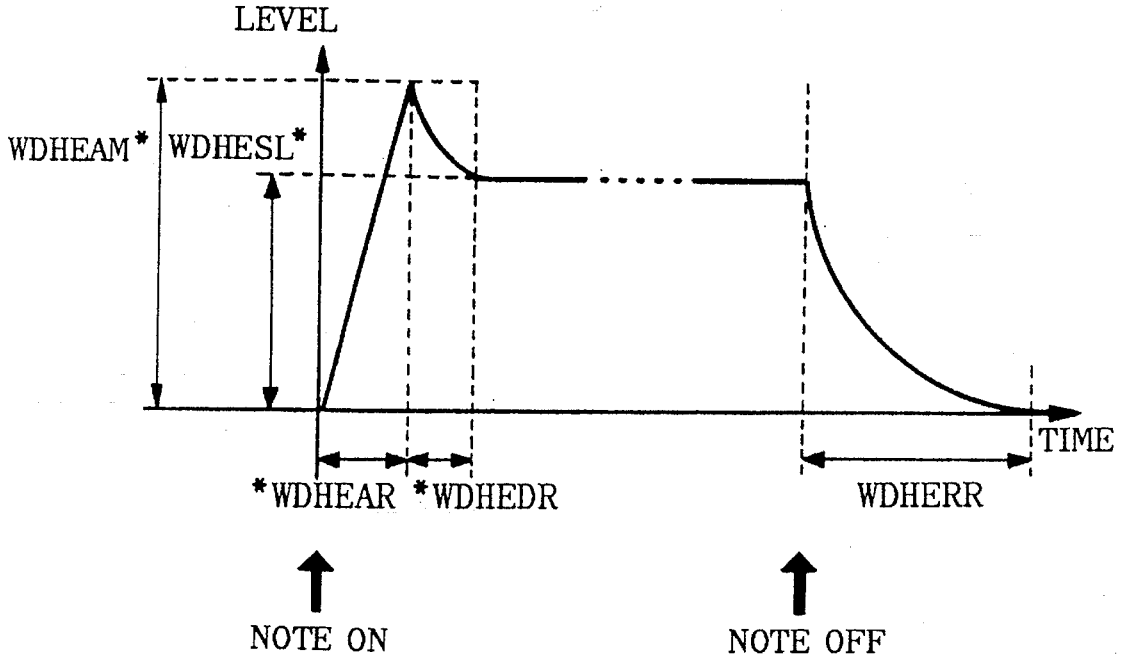
FIG. 12 is a graph showing a waveform of a jet-width envelope signal produced in a circuitry shown in 11.
Figure 13:
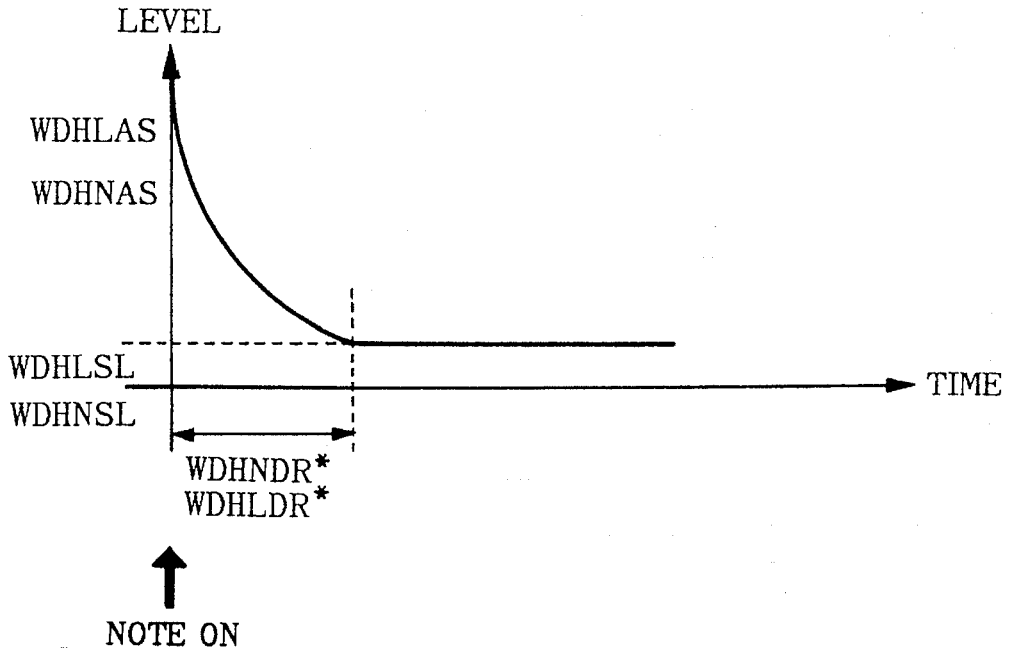
FIG. 13 is a graph showing a waveform of a noise envelope signal produced in the circuitry shown in FIG. 11.

The multiplier M8 multiplies the output signal of the multiplier M4 (i.e., the low-frequency signal, outputted from the low-frequency oscillator 46, which is applied with the envelope signal produced from the envelope generator 47) by another envelope signal produced from the jet-width envelope generator 48. Then, an output signal of the multiplier M8 is supplied to a multiplier M10. The multiplier M10 multiplies the output signal of the multiplier M8 by a LFO depth WDHLDP, and then, a result of the multiplication performed by the multiplier M10 is outputted to the adder A1. Finally, the adder A1 adds the output signals of the multipliers M6, M7, M9 and M10 together. Then, a result of the addition performed by the adder A1 is outputted to the second control portion 41 as the jet thickness parameter JWP. Incidentally, the above-mentioned parameters are shown in FIGS. 12 and 13.

According to the circuit configuration shown in FIG. 11, the jet thickness is controlled by the envelope generator 48, the low frequency oscillator 46 and the noise oscillator 43. Herein, the jet-width envelope generator 48 produces a variation of the jet thickness in a lapse of time at a note-on event or a note-off event, while the low frequency oscillator 46 and the noise oscillator 43 function to produce an unstableness of the jet thickness at a normal period or a transient period between the note-on event and note-off event. When changing the tone volume or tone quality by the after touch AFT, the jet thickness is directly increased or decreased. When controlling a tremolo depth by the after touch AFT, the jet thickness is increased or decreased by use of controlling the low frequency oscillator 46.

Figure 14:
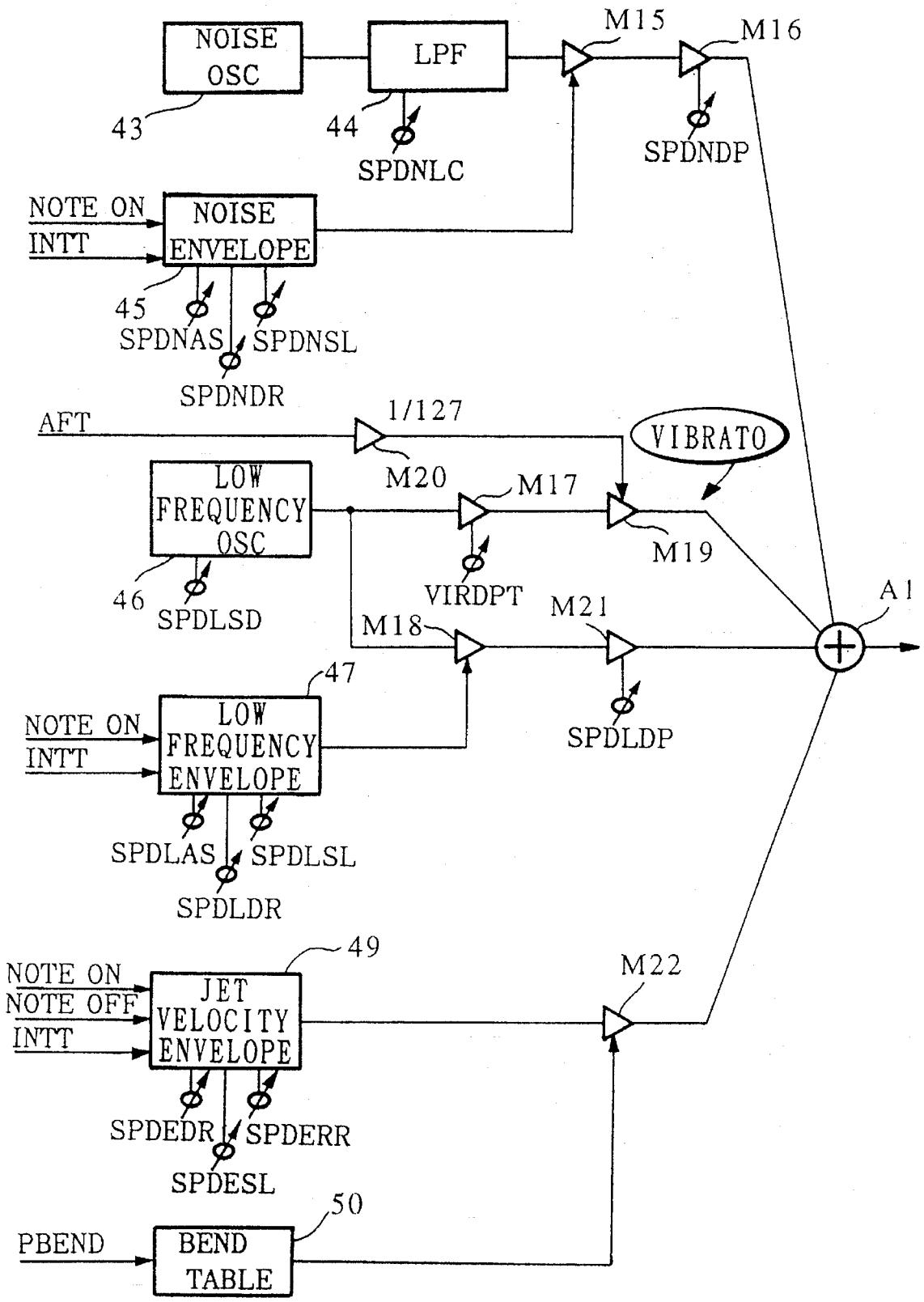
FIG. 14 is a block diagram showing another example of the first control portion shown in FIG. 10 which is configured when controlling a jet velocity.

Next, the detailed configuration of the first control portion 40 will be described by referring to FIGS. 14, 15, 16 and 17. In FIG. 14, part identical to those shown in FIG. 11 will be designated by the same numerals, hence, the description thereof will be omitted.

[Jet Velocity Control]

The low-pass filter 44 receives a cut-off frequency parameter SPDNLC which determines the cut-off frequency. The output of the low-pass filter 44 is supplied to a multiplier M15. The noise envelope generator 45 produces an envelope signal on the basis of the note-on signal NOTE ON, the initial touch INTT, an attack level SPDNAS, a decay rate SPDNDR and a sustain level SPDNSL supplied thereto. This envelope signal is outputted to the multiplier M15. Thus, the multiplier M15 multiplies the output signal of the low-pass filter 44 by the envelope signal produced from the noise envelope generator 45. Then, a result of the multiplication performed by the multiplier M15 is outputted to a multiplier M16. The multiplier M16 multiplies the output signal of the multiplier M15 by a noise depth SPDNDP. A result of the multiplication performed by the multiplier M16 is outputted to the adder A1.

The low frequency oscillator 46 produces a signal having a predetermined low frequency on the basis of a speed parameter SPDLSD. This signal is delivered to multipliers M17 and M18. The multiplier M17 multiplies the low frequency signal produced from the low frequency oscillator 46 by a vibrato depth VIRDPT, and then, a result of the multiplication is outputted to a multiplier M19. Meanwhile, the after touch AFT is multiplied by "1/127" by a multiplier M20, of which output (i.e., a value "AFT/127") is supplied to the multiplier M19. Thus, the multiplier M19 multiplies the output signal of the multiplier M17 by the value "AFT/127" given from the multiplier M20, and then, a result of the multiplication is supplied to the adder A1. The low-frequency envelope generator 47 produces an envelope signal on the basis of the note-on signal NOTE ON, the initial touch INTT, an attack level SPDLAS, a decay rate SPDLDR and a sustain level SPDLSL supplied thereto. This envelop signal is supplied to the multiplier M18. Thus, the multiplier M18 multiplies the low frequency signal given from the low frequency oscillator 46 by the envelope signal given from the low-frequency envelope generator 47, and then, a result of the multiplication is outputted to a multiplier M21. The multiplier M21 multiplies the output signal of the multiplier M18 by a depth SPDLDP, and then, a result of the multiplication is supplied to the adder A1.

Next, a jet-velocity envelope generator 49 produces an envelope signal on the basis of the note-on signal NOTE ON, note-off signal NOTE OFF, the initial touch INTT, a decay rate SPDEDR, a sustain level SPDESL and a release rate SPDERR. This envelope signal is supplied to a multiplier M22. Meanwhile, a pitch-bend value PBEND is supplied to the multiplier M22 by means of a bend table 50. The bend table 50 stores data values each corresponding to the pitch-bend value PBEND as shown in FIG. 17. Thus, a data value corresponding to the pitch-bend value PBEND inputted is read out from the bend table 50. Thus, the multiplier M22 multiplies the envelope signal given from the envelope generator 49 by the data value corresponding to the pitch-bend value PBEND, and then, a result of the multiplication is supplied to the adder A1. The adder A1 adds the output signals of the multipliers M16, M19, M21 and M22 together, and then, a result of the addition is outputted to the second control portion 41 shown in FIG. 10 as the jet velocity parameter JSP. Incidentally, the above-mentioned parameters are shown in FIGS. 15 and 16.

According to the jet velocity control performed by the above-mentioned circuitry shown in FIG. 14, the jet velocity is eventually represented by a reverse value of the jet velocity, in other words, a time which is required until the jet flow passing through the slit reaches the edge. According to the jet velocity control, a jet traveling velocity is reduced from the infinite to a certain value at the note-on moment, while the jet traveling velocity is increased from the certain value to the infinite in a lapse of time at the note-off moment. In order to do so, the low frequency oscillator 46 and the noise oscillator 43 function to create the envelope and also produce the unstableness of the jet traveling velocity at the transient period and the normal period. In order to alter the interval and the tone quality by the pitch bending operation, the jet traveling velocity is controlled by referring to the bend table 50 with respect to the pitch-bend value PBEND. When controlling the vibrator depth by changing the after touch AFT, the jet traveling velocity is directly increased or decreased by controlling the low frequency oscillator 46.

Figure 18:
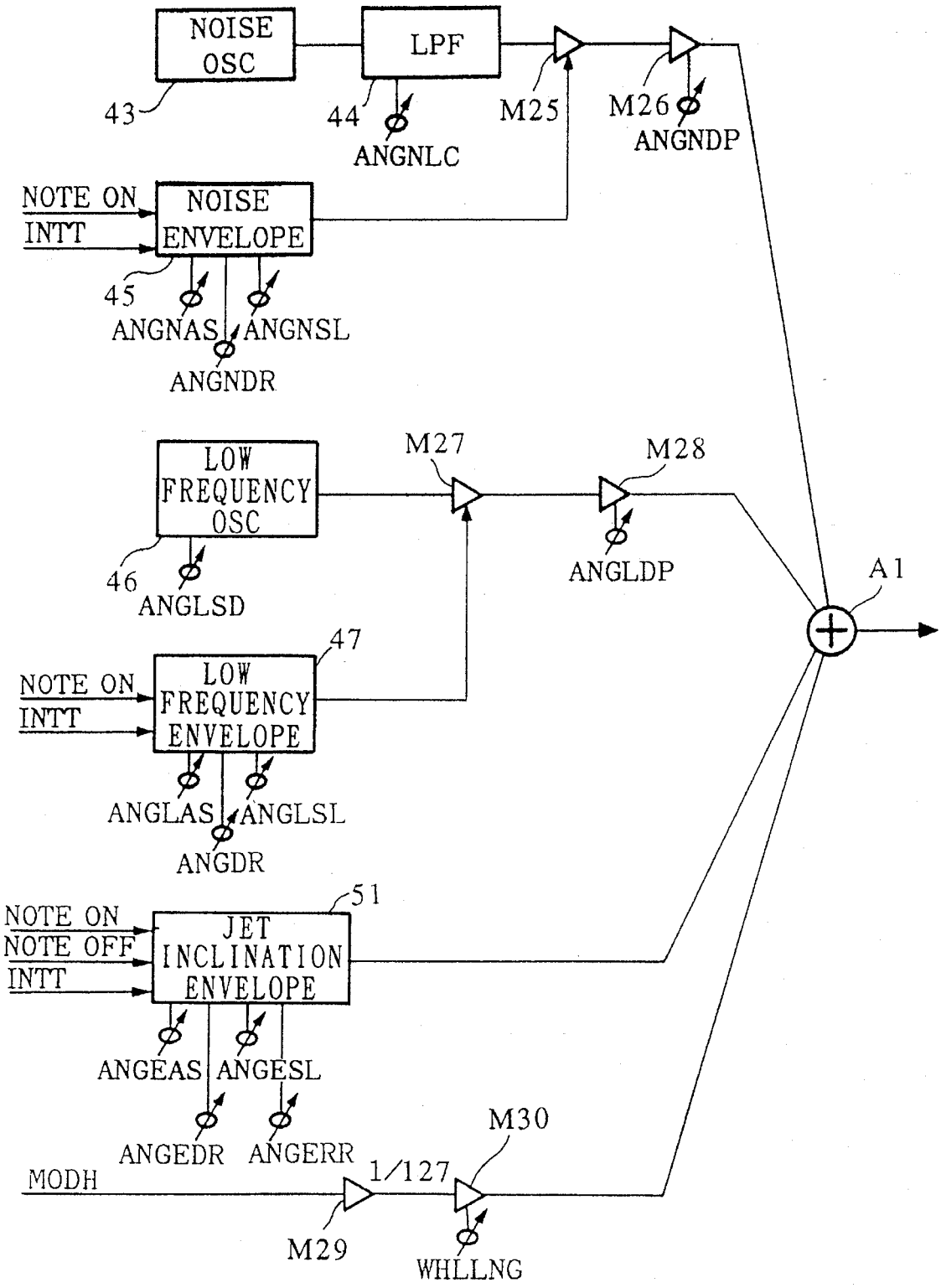
FIG. 18 is a block diagram showing a further example of the first control portion which is configured when controlling a jet inclination.
Figure 19:
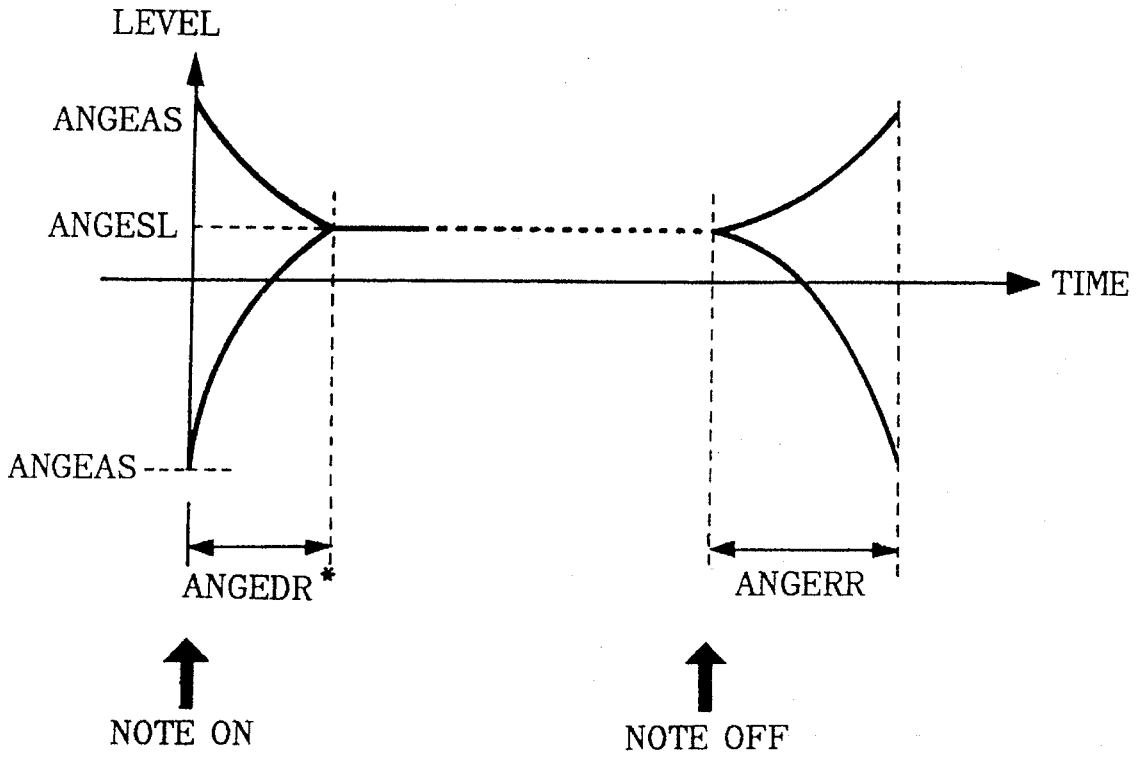
FIG. 19 is a graph showing a waveform of a jet-inclination envelope signal produced in a circuitry shown in FIG. 18.
Figure 20:
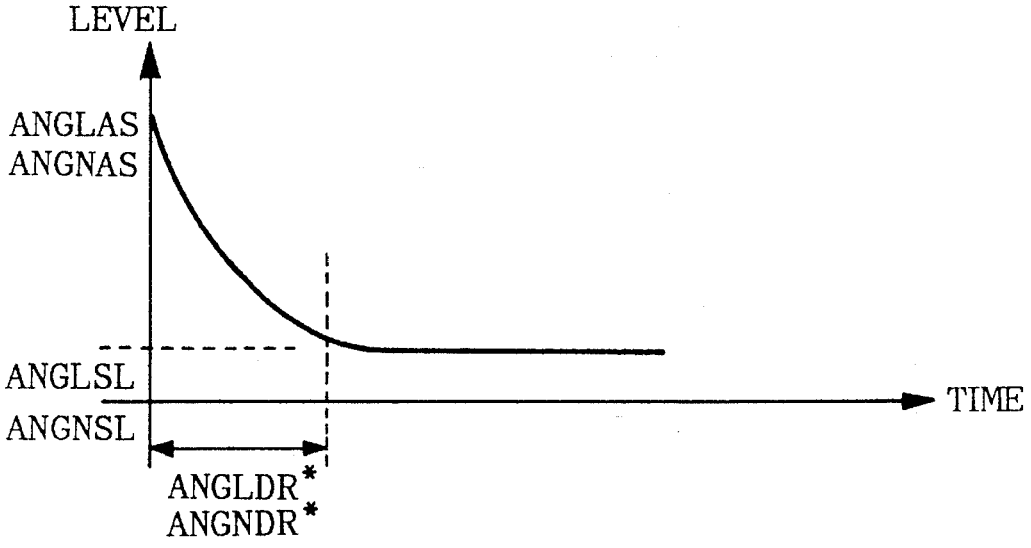
FIG. 20 is a graph showing a waveform of a noise envelope signal produced in the circuitry shown in FIG. 18.

Next, a detailed configuration of the first control portion 40 when performing a jet inclination control will be described by referring to FIGS. 18, 19 and 20. In FIG. 18, parts identical to those shown in FIGS. 11 and 14 will be designated by the same numerals, hence, the description thereof will be omitted.

[Jet Inclination Control]

The low-pass filter 44 receives a cut-off frequency parameter ANGNLC which determines the cut-off frequency. The output of the low-pass filter 44 is supplied to a multiplier M25. Meanwhile, the noise envelope generator 45 produces an envelope signal on the basis of the note-on signal NOTE ON, the initial touch INTT, an attack level ANGNAS, a decay rate ANGNDR and a sustain level ANGNSL supplied thereto. This envelop signal is supplied to the multiplier M25. The multiplier M25 multiplies the output signal of the low-pass filter 44 by the envelope signal given from the noise envelope generator 45, and then, a result of the multiplication is supplied to a multiplier M26. The multiplier M26 multiplies the output signal of the multiplier M25 by a noise depth ANGNDP, and then, a result of the multiplication is outputted to the adder A1.

The low frequency oscillator 46 produces a low frequency signal having a predetermined low frequency on the basis of the speed parameter ANGLSD which is used when performing the jet inclination control. This low frequency signal is supplied to a multiplier M27. The low-frequency envelope generator 47 produces an envelope signal on the basis of the note-on signal NOTE ON, the initial touch INTT, an attack level ANGLAS, a decay rate ANGLDR and a sustain level ANGLSL. This envelope signal is supplied to the multiplier M27. Thus, the multiplier M27 multiplies the low frequency signal given from the low frequency oscillator 46 by the envelope signal given from the low-frequency envelope generator 47, and then, a result of the multiplication is supplied to a multiplier M28. The multiplier M28 multiplies the output signal of the multiplier M27 by a depth ANGLDP, and then, a result of the multiplication is supplied to the adder A1.

Next, a jet-inclination envelope generator 51 produces an envelope signal on the basis of the note-on signal NOTE ON, the note-off signal NOTE OFF, the initial touch INTT, an attack level ANGEAS, a decay rate ANGEDR, a sustain level ANGESL and a release rate ANGERR. This envelope signal is supplied to the adder A1.

Meanwhile, a modulation wheel parameter MODH is multiplied by a value "1/127" in a multiplier M29, of which output (i.e., a value "MODH/127") is supplied to a multiplier M30. The multiplier M30 multiplies the output of the multiplier M29 by a mode range parameter WHLLNG, and then, a result of the multiplication is supplied to the adder A1. Finally, the adder A1 adds the output signals of the multipliers M26, M28 and M30 together, so that a result of the addition is outputted to the second control portion 41 as the jet inclination parameter JAP. Incidentally, the above-mentioned parameters are shown in FIGS. 19 and 20.

According to the jet inclination control performed by the circuitry shown in FIG. 18, under the operations of the low frequency oscillator 46 and the noise oscillator 43, the envelope is produced in order to control the distance between the jet center and the edge in accordance with the time variation between the note-on moment and the note-off moment, while the unstableness is applied to the jet inclination at the transient time and the normal time in the note-on event. Incidentally, a variation of the aforementioned modulation wheel parameter directly reflects on the jet inclination.

Next, a detailed configuration of the first control portion 40 when controlling the edge tone and the aeolian tone will be described by referring to FIGS. 21 and 22.

[Edge Tone Control (or Aeolian Tone Control)]

Figure 21:
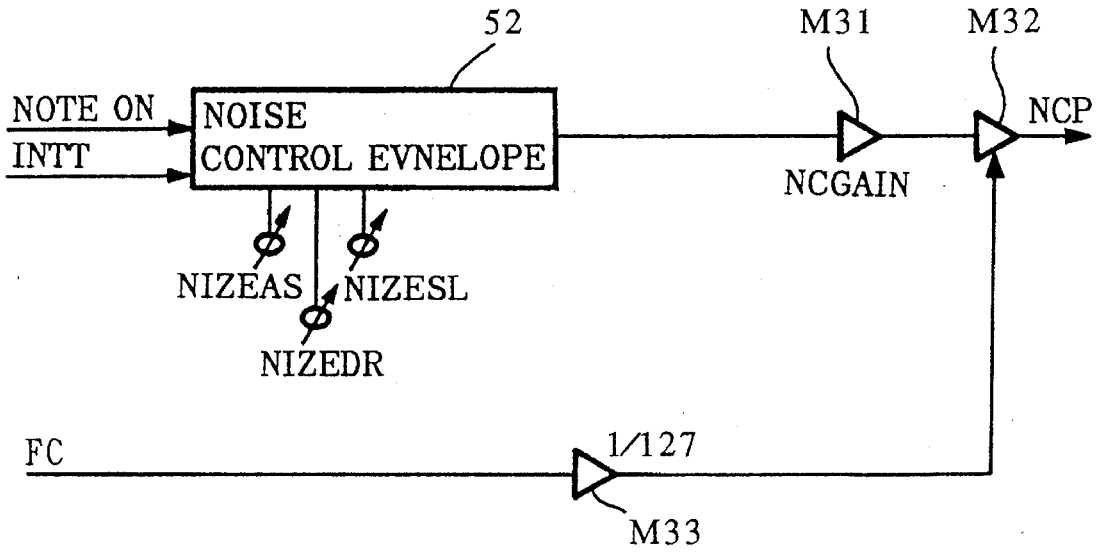
FIG. 21 is a block diagram showing a still further example of the first control portion which is configured when controlling an edge tone.
Figure 22:
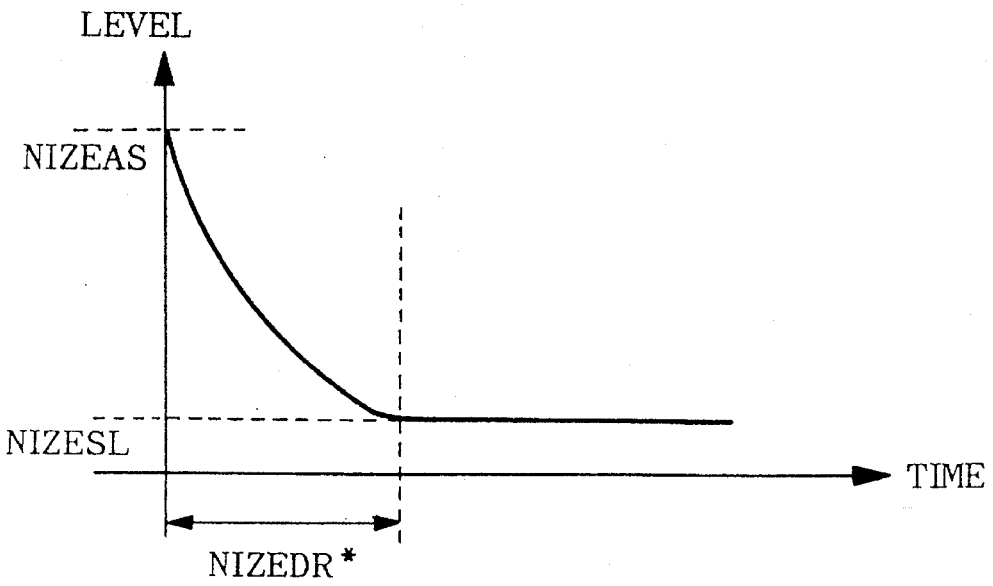
FIG. 22 is a graph showing a waveform of a noise-control envelope signal produced in a circuitry shown in FIG. 21.

In FIG. 21, a noise-control envelope generator 52 generates an envelope signal as shown in FIG. 22 on the basis of the note-on signal NOTE ON, the initial touch INTT, an attack level NIZEAS, a decay rate NIZEDR and a sustain level NIZESL supplied thereto. This envelope signal is supplied to a multiplier M31. The multiplier M31 multiplies the envelope signal by a noise gain NCGAIN, and then, a result of the multiplication is supplied to a multiplier M32. Meanwhile, a multiplier M33 multiplies a parameter FC supplied thereto by a value "1/127", and then, a result of the multiplication is supplied to the multiplier M32. The multiplier M32 multiplies the output of the multiplier M31 by the output of the multiplier M33, and then, a result of the multiplication is outputted to the second control portion 41 as the noise control parameter NCP shown in FIG. 10.

[Control Portion 41]

Figure 23:
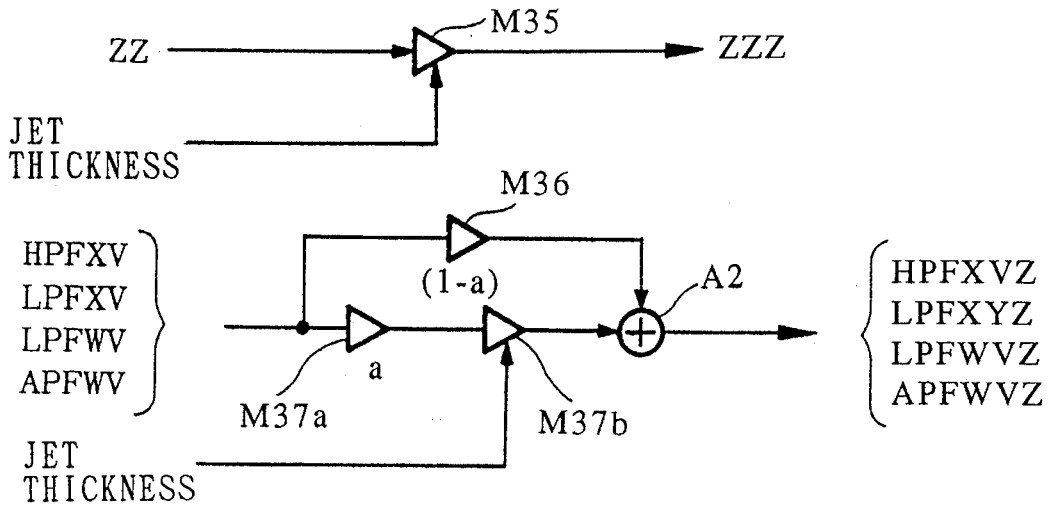
FIG. 23 is a block diagram showing an example of a second control portion shown in FIG. 10 which is configured when controlling the jet thickness.

Next, detailed configurations and operations of the second control portion 41 will be described. FIG. 23 is a block diagram showing a detailed configuration of the second control portion 41 which is suitable for controlling the jet thickness. In FIG. 23, a multiplier M35 receives the jet thickness ZZ and the jet thickness parameter JWP outputted from the first control portion 40. The jet thickness ZZ is supplied to the multiplier M35 in response to the tone color of the musical tone to be produced. Then, the multiplier M35 multiplies the jet thickness ZZ by the jet thickness parameter JWP so as to produce a multiplication result ZZZ, which outputted to the DSP 42 (i.e., algorithm portion 42). As described before, predetermined algorithms are implemented to the DSP 42. Both of multipliers M36 and M37*a* receive the high-pass filter coefficient HPFXV, the low-pass filter coefficient LPFXY, the low-pass filter coefficient LPFWV and an all-pass filter coefficient APFWV. The multiplier M36 multiplies each of the filter coefficients by a predetermined coefficient (1−a) (where $0 \leqq a \leqq 1$) so as to output a multiplication result to an adder A2. On the other hand, the multiplier M37*a* multiplies each of the above-mentioned filter coefficients by a coefficient "a" so as to output a multiplication result to a multiplier M37*b*. The multiplier M37*b* further multiplies the output of the multiplier M37*a* by the foregoing jet thickness parameter JWP, and then, a multiplication result thereof is outputted to the adder A2. The adder A2 adds the outputs of the multipliers M36 and M37*b* together so as to produce the high-pass filter coefficient HPFXVZ, the low-pass filter coefficient LPFXYZ, the low-pass filter coefficient LPFWVZ and an all-pass filter coefficient APFWVZ, which are respectively supplied to the DSP 42 shown in FIG. 10.

Figure 24:
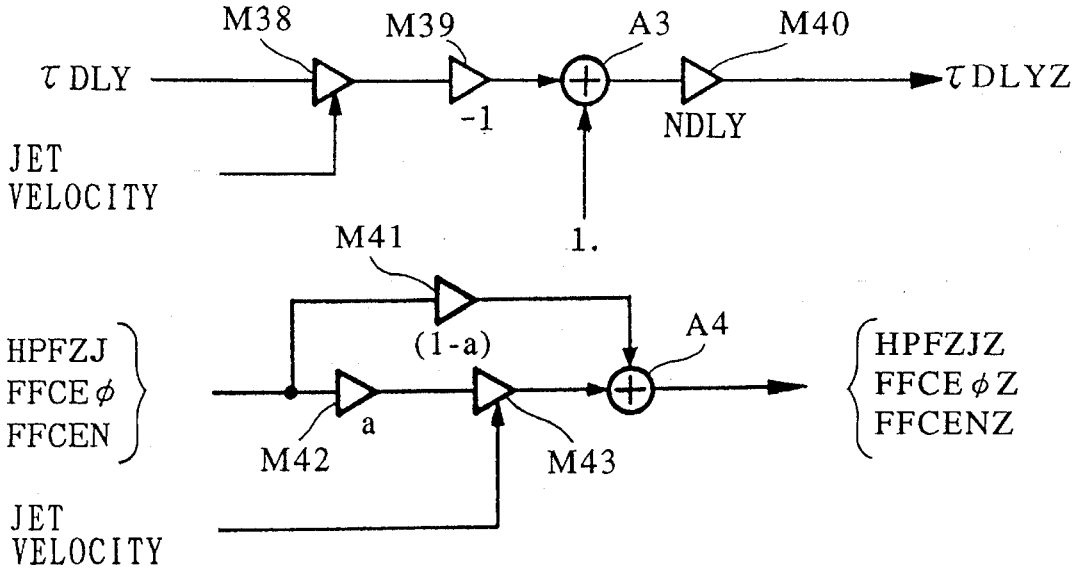
FIG. 24 is a block diagram showing another example of the second control portion which is configured when controlling the jet velocity.

FIG. 24 is a block diagram showing a detailed configuration of the second control portion 41 which is suitable for controlling the jet velocity. In FIG. 24, a delay amount τ DLY is required when the jet flow which is given in response to the tone color of the musical tone to be produced travels between the slit and the edge. A multiplier M38 multiplies the delay amount τ DLY by the foregoing jet velocity parameter JSP outputted from the first control portion, and then, a multiplication result thereof is outputted to a multiplier M39. The multiplier M39 multiplies the output of the multiplier M38 by a coefficient "1" so as to output a multiplication result thereof to an adder A3. The adder A3 adds a value "1" to the output of the multiplier M39 so as to output an addition result thereof to a multiplier M40. The multiplier M40 multiplies the output of the adder A3 by the delay amount NDLY representing a pipe length, and then, a multiplication result thereof is outputted to the aforementioned DSP 42 as a delay amount τ DLYZ.

Meanwhile, a set of the high-pass filter coefficient HPFZJ, the feed-forward comb filer coefficients FFCE0 and FFCEN are produced in response to the tone color of the musical tone to be produced. These filter coefficients are supplied to both of multipliers M40 and M41. Then, the multiplier M41 multiplies each of these filter coefficients by the coefficient (1−a) so as to output a multiplication result thereof to an adder A4. On the other hand, the multiplier M42 multiplies each of the filter coefficients by the coefficient "a" so as to output a multiplication result thereof to a multiplier M43. The multiplier M43 multiplies the output of the multiplier M42 by the aforementioned jet velocity parameter JSP outputted from the first control portion 40, and then, a multiplication result thereof is outputted to the adder A4. The adder A4 adds the outputs of the multipliers M41 and M43 together so as to produce a high-pass filter coefficient HPFZJZ, a feed-forward comb filter coefficient FFCEOZ and FFCENZ, all of which are supplied to the DSP 42.

Figure 25:
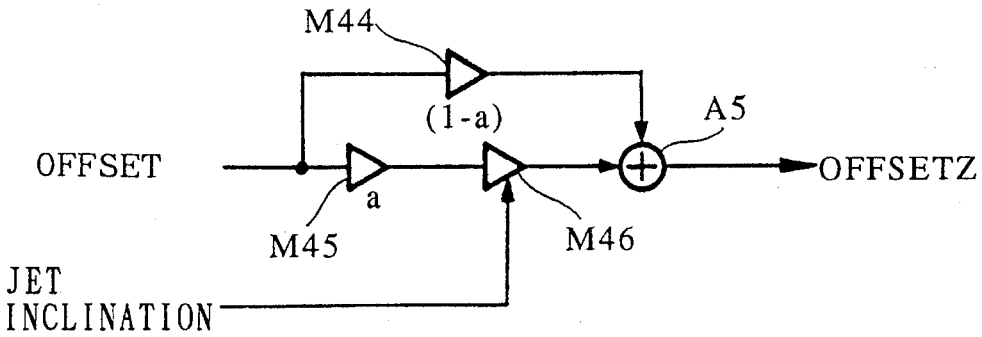
FIG. 25 is a block diagram showing a further example of the second control portion which is configured when controlling the jet inclination.

FIG. 25 is a block diagram showing a detailed configuration of the second control portion 41 which is suitable for controlling the jet inclination. In FIG. 25, each of multipliers M44 and M45 receive an offset value "OFFSET" which is applied to the address when reading data from the non-linear table. The multiplier M44 multiplies the offset value OFFSET by the coefficient (1−a) so as to output a multiplication result thereof to an adder A5. On the other hand, the multiplier M45 multiplies the offset value OFFSET by the coefficient "a" so as to output a multiplication result thereof to a multiplier M46. The multiplier M46 multiplies the output of the multiplier M45 by the aforementioned jet inclination parameter JAP outputted from the first control portion 40 so as to output a multiplication result thereof to the adder A5. The adder A5 adds the outputs of the multipliers M44 and M46 together so as to produce a new offset value OFFSETZ to the DSP 42.

Figure 26:
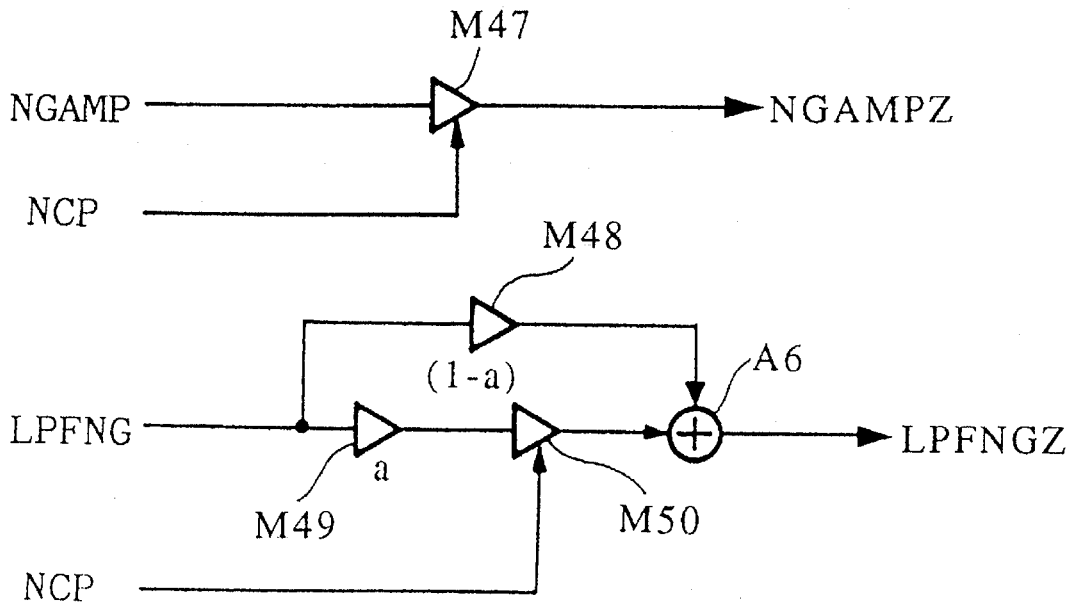
FIG. 26 is a block diagram showing a still further example of the second control portion which is configured when controlling the noise.

FIG. 26 is a block diagram showing a detailed configuration of the second control portion 41 which is suitable for controlling the noise. In FIG. 26, a multiplier M47 multiplies the coefficient NGAMP by the noise control parameter outputted from the first control portion 40, wherein the coefficient NGAMP is used to control the amplitude of the waveform of the edge tone. Then, a multiplication result produced from the multiplier M47 is outputted to the DSP 42 as an amplitude control coefficient NGAMPZ. Meanwhile, multipliers M48 and M49 receive the low-pass filter coefficient LPFNG. The multiplier M48 multiplies the low-pass filter coefficient LPFNG by the coefficient (1–a) so as to output a multiplication result thereof to an adder A6. On the other hand, the multiplier M49 multiplies the low-pass filter coefficient LPFNG by the coefficient "a" so as to output a multiplication result thereof to a multiplier M50. The multiplier M50 further multiplies the output of the multiplier M49 by the noise control parameter NCP outputted from the first control portion 40. Then, a multiplication result produced from the multiplier M50 is supplied to the adder A6. The adder A6 adds the outputs of the multipliers M48 and M50 together so as to output an addition result thereof to the DSP 42 as a new low-pass filter coefficient LPFNGZ.

Figure 27:
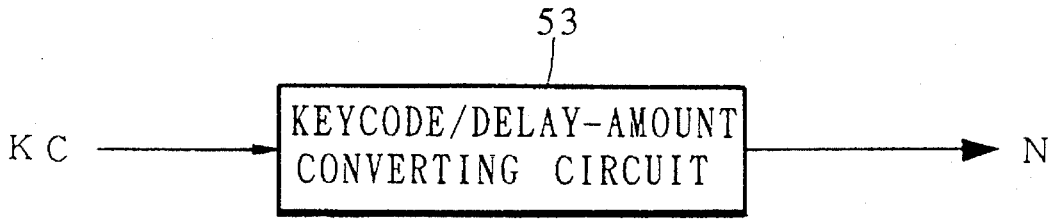
FIG. 27 is a block diagram showing an operating element which creates a delay amount N to be supplied to a DSP 42 shown in FIG. 10.

FIG. 27 is a block diagram showing an operating element 53 which produces the delay amount N (see FIG. 9) to be supplied to the DSP 42 shown in FIG. 10. More specifically, a numeral 53 designates a keycode/delay-amount converting circuit in which the delay amount N is calculated by use of the keycode KC or in which the delay amount N is read from a table in response to the keycode KC. Then, the delay amount N is supplied to the DSP 42 shown in FIG. 10.

As described heretofore, the second control portion 41 calculates the parameters used in the DSP 42 on the basis of three parameters relating to the jet flow (i.e., JWP, JSP and JAP), the noise control parameter NCP and the keycode (corresponding to the delay amount N). A correspondence between the inputs and the outputs of the second control portion 41 is shown in FIG. 30.

When performing the key scaling operation, all of the parameters to be required are sent to the DSP 42. When controlling the jet thickness, the jet thickness ZZ, the high-pass filter coefficient HPFXV, the low-pass filter coefficients LPFXV, LPFWV and the all-pass filter coefficient APFWV are supplied to the DSP 42. Herein, the jet thickness ZZ represents a multiplication coefficient which controls a range of the output of the non-linear table. On the other hand, when controlling the jet velocity, the high-pass filter coefficient HPFZJ, the feed-forward comb filter coefficients FFCEτ, FFCE0 and the delay amount τ DLY are supplied to the DSP 42. Further, when controlling the jet inclination, the offset value OFFSET is supplied to the DSP 42. Furthermore, when controlling the noise control parameter NCP, the low-pass filter coefficient LPFNG and the multiplication coefficient NGAMP are supplied to the DSP 42. As described before, the multiplication coefficient NGAMP is used to control the amplitude of the waveform of the edge tone.

Incidentally, the present embodiment described heretofore can be modified such that the non-linear function used for the simulation of the jet reed is replaced by the following functional calculations.

$$NL1 \rightarrow Qe = -Ga * tanh(Gb * \epsilon_e)$$

,where terms Ga, Gb are predetermined constants.

$$NL2\ Nac = Gc/(|\epsilon_e|)^{1/2}$$

,where $\epsilon_e$ is not equal to zero, while a term Gc is a predetermined coefficient.

Figure 28:
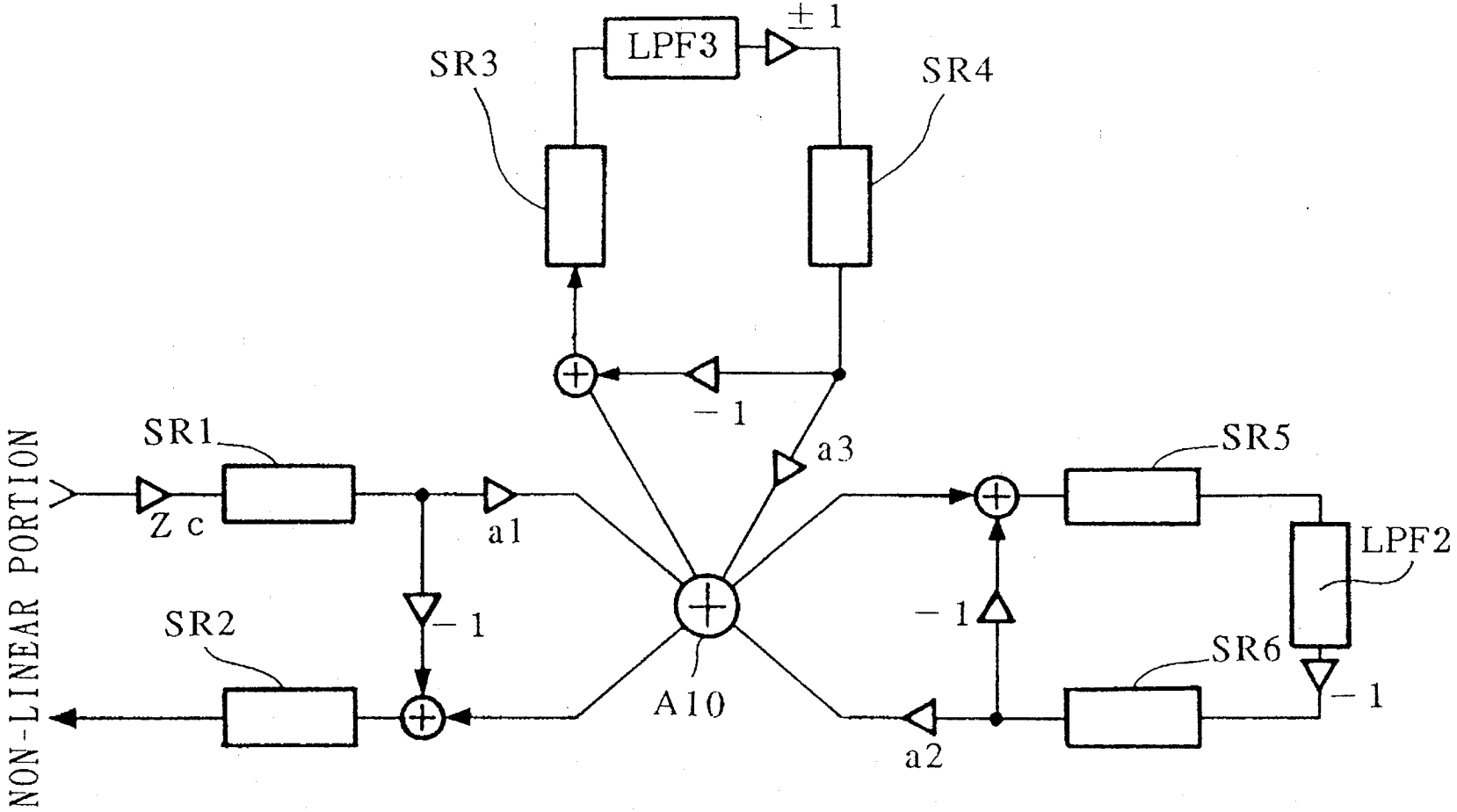
FIG. 28 is a block diagram showing an example of a linear portion simulating a pipe providing a tone hole.

In the embodiment, the linear portion is configured to model a straight pipe. However, it is possible to modify the linear portion to model another pipe providing tone holes. In this case, the configuration of the linear portion can be modified as shown in FIG. 28. In FIG. 28, each of shift registers SR1, SR2, . . . , SR6 works as a delay element, while an adder A10 is provided to embody a junction operation which is emerged at the tone hole.

Figure 29:
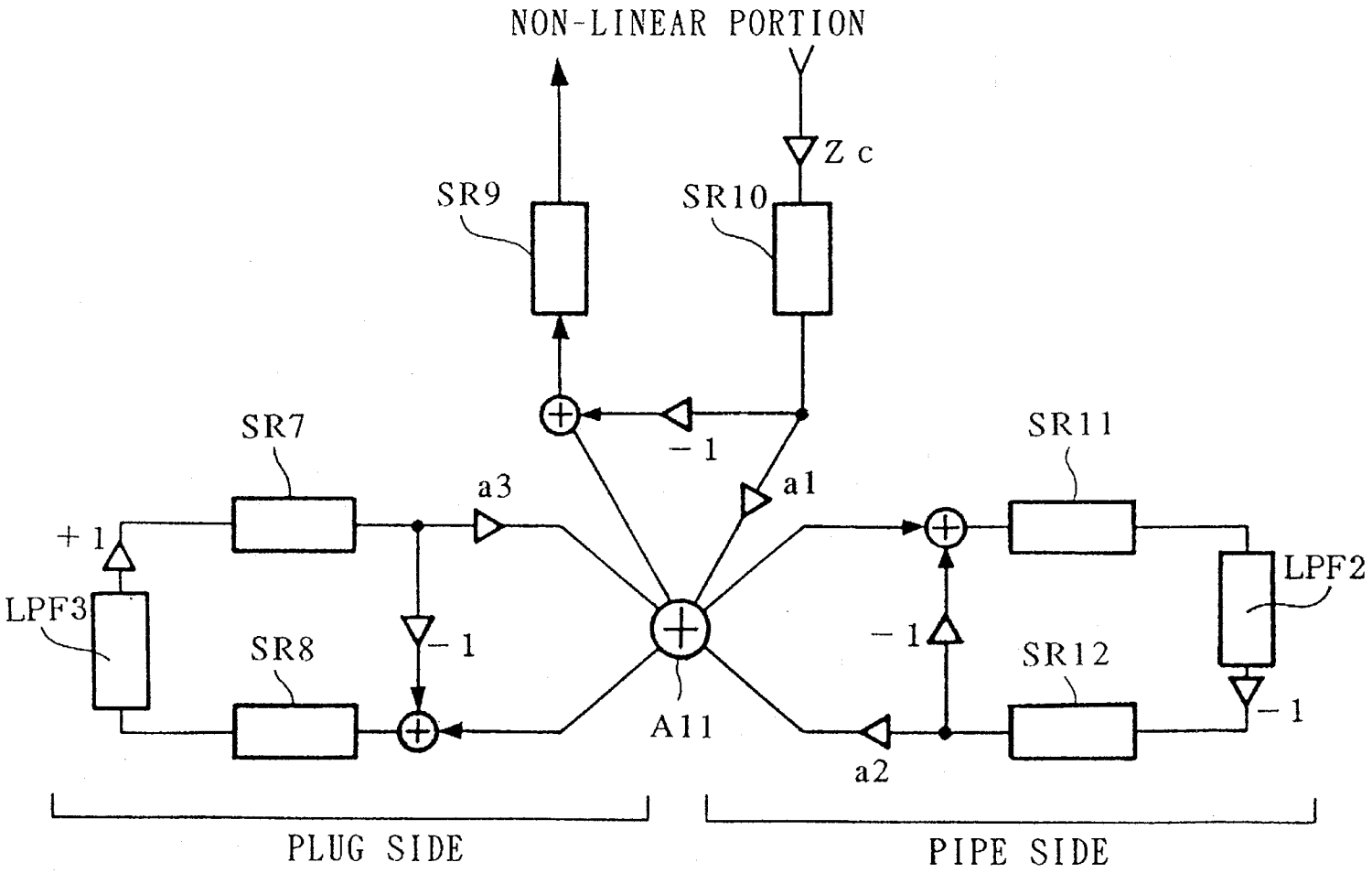
FIG. 29 is a block diagram showing another example of the linear portion.

Under the consideration of the location of the mouth portion of the flute to be simulated, a part of the circuitry is divided so that the output of the non-linear portion is partially branched to a plug side of the flute pipe. In this case, the aforementioned circuit block B (see FIG. 6) corresponding to the linear portion simulating the pipe portion of the instrument is modified as shown in FIG. 29. In FIG. 29, each of shift registers SR7, SR8, . . . , SR12 works as a delay element at the mouth portion of the flute, while an adder A11 embodies the junction operation as similar to the circuitry shown in FIG. 28.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument comprising:

a linear portion which at least imparts a first delay time to an input signal thereof, said first delay time corresponding to a tone pitch of a musical tone to be produced;

a non-linear portion which performs a predetermined non-linear function on an input signal thereof, said non-linear portion being connected with said linear portion to form a loop circuit;

delay means for imparting a second delay time to an input signal thereof, so that a delayed output of said delay means is supplied to said non-linear portion as its input signal, said second delay time corresponding to a tone color of a musical tone to be produced; and excitation means for generating an excitation signal in response to an output signal from said delay means;

whereby said excitation signal is applied to and is circulated through said loop circuit, so that a signal picked up from said loop circuit is output as a musical tone signal.

2. An electronic musical instrument comprising:

a linear portion which at least imparts a first delay time to an input signal thereof said first delay time corresponding to a tone pitch of a musical tone to be produced;

a non-linear portion which performs a predetermined non-linear function on an input signal thereof, said non-linear portion being connected with said linear portion to form a loop circuit; and delay means for imparting a second delay time to an input signal thereof, so that a delayed output of said delay means is supplied to said non-linear portion as its input signal, said second delay time corresponding to a tone color of a musical tone to be produced, whereby an excitation signal is applied to and is circulated through said loop circuit, so that a signal picked up from said loop circuit is output as a musical tone signal, and whereby said second delay time corresponds to a traveling time of an air flow which is transmitted through a pipe of a wind instrument, so that said musical tone signal simulates a sound of the wind instrument.

3. An electronic musical instrument comprising:

a linear portion which at least imparts a first delay time to an input signal thereof, said first delay time corresponding to a tone pitch of a musical tone to be produced;

a non-linear portion which performs a predetermined non-linear function on an input signal thereof, said non-linear portion being connected with said linear portion to form a loop circuit;

delay means for imparting a second delay time to an input signal thereof, so that a delayed output of said delay means is supplied to said non-linear portion as its input signal, said second delay time corresponding to a tone color of a musical tone to be produced; and noise generating means which generates a noise signal, said noise signal being supplied to said non-linear portion, wherein said noise signal simulates a sound effect which occurs when the air flow collides with an edge of the pipe of a wind instrument to be simulated, whereby an excitation signal is applied to and is circulated through said loop circuit so that a signal picked up from said loop circuit is output as a musical tone signal.

4. An electronic musical instrument comprising:

an excitation means for producing an excitation signal, said excitation means containing a comb filter and a non-linear means, said comb filter at least imparting a predetermined delay time to an input signal thereof, while said non-linear means performs a non-linear function on an output of said comb filter so that an output of said non-linear means is used for producing said excitation signal;

a control signal generating means for generating a control signal containing a noise component, said control signal being supplied to said excitation means, so that said excitation means produces said excitation signal by use of said control signal; and a wave transmission means for delaying said excitation signal given from said excitation means by a delay time corresponding to a tone pitch of a musical tone to be produced.

5. An electronic musical instrument as defined in claim 4 wherein said control signal contains a noise signal and an envelope signal.

6. An electronic musical instrument comprising:

a performance information creating means for creating performance information representing a musical performance made by a performer;

a parameter producing means for producing at least one parameter on the basis of said performance information, said parameter representing a characteristic of a jet reed instrument to be simulated;

an excitation means for producing an excitation signal on the basis of said parameter, said excitation means containing a comb filter and a non-linear means, said comb filter at least imparting a predetermined delay time to an input signal thereof, while said non-linear means performs a non-linear function on an output of said comb filter so that an output of said non-linear means is used for producing said excitation signal; and a wave transmission means for delaying said excitation signal given from said excitation means by a delay time corresponding to a tone pitch of a musical tone to be produced, said wave transmission means also carrying out a signal processing on said excitation signal in accordance with said parameter.

7. An electronic musical instrument as defined in claim 6 further comprising a control signal generating means which generates a control signal containing a noise component in accordance with said parameter, said control signal being supplied to said excitation means, so that said excitation means produces said excitation signal by use of said control signal.

8. A method for synthesizing musical tones comprising the steps of:

forming a loop circuit comprising a linear portion and a non-linear portion, and delay means;

imparting a first delay time to an input signal of said linear portion, said first delay time corresponding to a tone pitch of a musical tone to be produced;

performing a predetermined non-linear function on a input signal of said non-linear portion; and imparting a second delay time to an input signal of said delay means, so that a delayed output of said delay means is supplied to said non-linear portion as its input signal;

producing an excitation signal in response to an output signal from said delay means;

applying and circulating said excitation signal through said loop circuit, so that a signal picked up from said loop circuit is output as a musical tone signal.

9. The method for synthesizing musical tones as recited in claim 8, whereby said second delay time corresponds to a traveling time of an air flow which is transmitted through a pipe of a wind instrument, so that said musical tone signal simulates a sound of the wind instrument.

10. The method for synthesizing musical tones as recited in claim 8, further comprising the step of:

generating a noise signal, said noise signal being supplied to said non-linear portion, wherein said noise signal simulates a sound effect which occurs when the air flow collides with an edge of a pipe of a wind instrument to be simulated.

* * * * *